US012709974B2

(12) United States Patent
Hopwood

(10) Patent No.: US 12,709,974 B2
(45) Date of Patent: Aug. 18, 2026

(54) SYSTEMS AND METHODS FOR TORQUE UNWIND

(71) Applicant: Helmerich & Payne, Inc., Tulsa, OK (US)

(72) Inventor: Fergus Hopwood, Houston, TX (US)

(73) Assignee: Helmerich & Payne, Inc., Tulsa, OK (US)

( * ) Notice: Subject to any disclaimer, the term of this patent is extended or adjusted under 35 U.S.C. 154(b) by 0 days.

(21) Appl. No.: 18/891,850

(22) Filed: Sep. 20, 2024

(65) Prior Publication Data

US 2025/0101853 A1 Mar. 27, 2025

Related U.S. Application Data

(60) Provisional application No. 63/584,419, filed on Sep. 21, 2023, provisional application No. 63/584,430, filed on Sep. 21, 2023.

(51) Int. Cl.
*E21B 44/04* (2006.01)
*E21B 7/04* (2006.01)

(52) U.S. Cl.
CPC ..... *E21B 44/04* (2013.01); *E21B 7/046* (2013.01)

(58) Field of Classification Search
CPC ..... E21B 44/04
See application file for complete search history.

(56) References Cited

U.S. PATENT DOCUMENTS 10,233,740 B2 * 3/2019 Patterson ..... G05B 19/404
11,466,556 B2 * 10/2022 Hopwood ..... E21B 21/103
12,012,841 B2 * 6/2024 Madhireddy ..... E21B 3/022
12,168,924 B2 * 12/2024 Hopwood ..... E21B 44/00
2004/0118608 A1 * 6/2004 Haci ..... E21B 44/00 175/26

(Continued)

FOREIGN PATENT DOCUMENTS

CN 113294088 A * 8/2021 ..... E21B 3/02
CN 117248882 A * 12/2023 ..... E21B 44/04

(Continued)

OTHER PUBLICATIONS

EP24201785.3, "Extended European Search Report", Feb. 12, 2025, 15 pages.

*Primary Examiner* — Jennifer H Gay
(74) *Attorney, Agent, or Firm* — Kilpatrick Townsend & Stockton LLP

(57) ABSTRACT

While regulating the top drive during drilling operations, if an unwind is commanded within the control system the following steps may be taken: the top drive may be stopped in speed mode. Once stopped, the control system may be placed into torque mode with a zero-torque reference. The sign of the torque feedback may then be used to determine the direction to configure the speed limit control. A positive torque feedback may indicate that to release torque the top drive may rotate in a reverse direction thus the speed limit may be applied in a reverse rotation direction. A negative torque feedback may indicate that to release torque the top drive may rotate in a forward direction thus the speed limit may be applied to the forward rotation direction. Once the torque and speed fall below threshold values, the control system may raise a flag indicating that the unwind has completed.

18 Claims, 14 Drawing Sheets

(56) References Cited

U.S. PATENT DOCUMENTS

| | | | | |
|---|---|---|---|---|
| 2004/0118612 | A1* | 6/2004 | Haci | E21B 44/00 175/73 |
| 2007/0256861 | A1* | 11/2007 | Hulick | E21B 7/06 175/26 |
| 2007/0256863 | A1* | 11/2007 | Hulick | E21B 7/046 166/177.6 |
| 2018/0073344 | A1* | 3/2018 | Patterson | E21B 3/022 |
| 2020/0362687 | A1* | 11/2020 | Hopwood | E21B 44/02 |
| 2022/0127923 | A1* | 4/2022 | Matheus Valero | E21B 44/04 |
| 2022/0356797 | A1* | 11/2022 | Hopwood | E21B 47/024 |
| 2022/0412204 | A1 | 12/2022 | Hopwood et al. | |
| 2023/0184082 | A1* | 6/2023 | Madhireddy | E21B 3/02 175/24 |
| 2025/0059876 | A1* | 2/2025 | Hopwood | E21B 7/046 |
| 2025/0101853 | A1* | 3/2025 | Hopwood | E21B 44/04 |

FOREIGN PATENT DOCUMENTS

| | | | | |
|---|---|---|---|---|
| EP | 4528072 | A1 * | 3/2025 | E21B 19/165 |
| WO | 2007129120 | A1 | 11/2007 | |
| WO | 2021188432 | A1 | 9/2021 | |

* cited by examiner

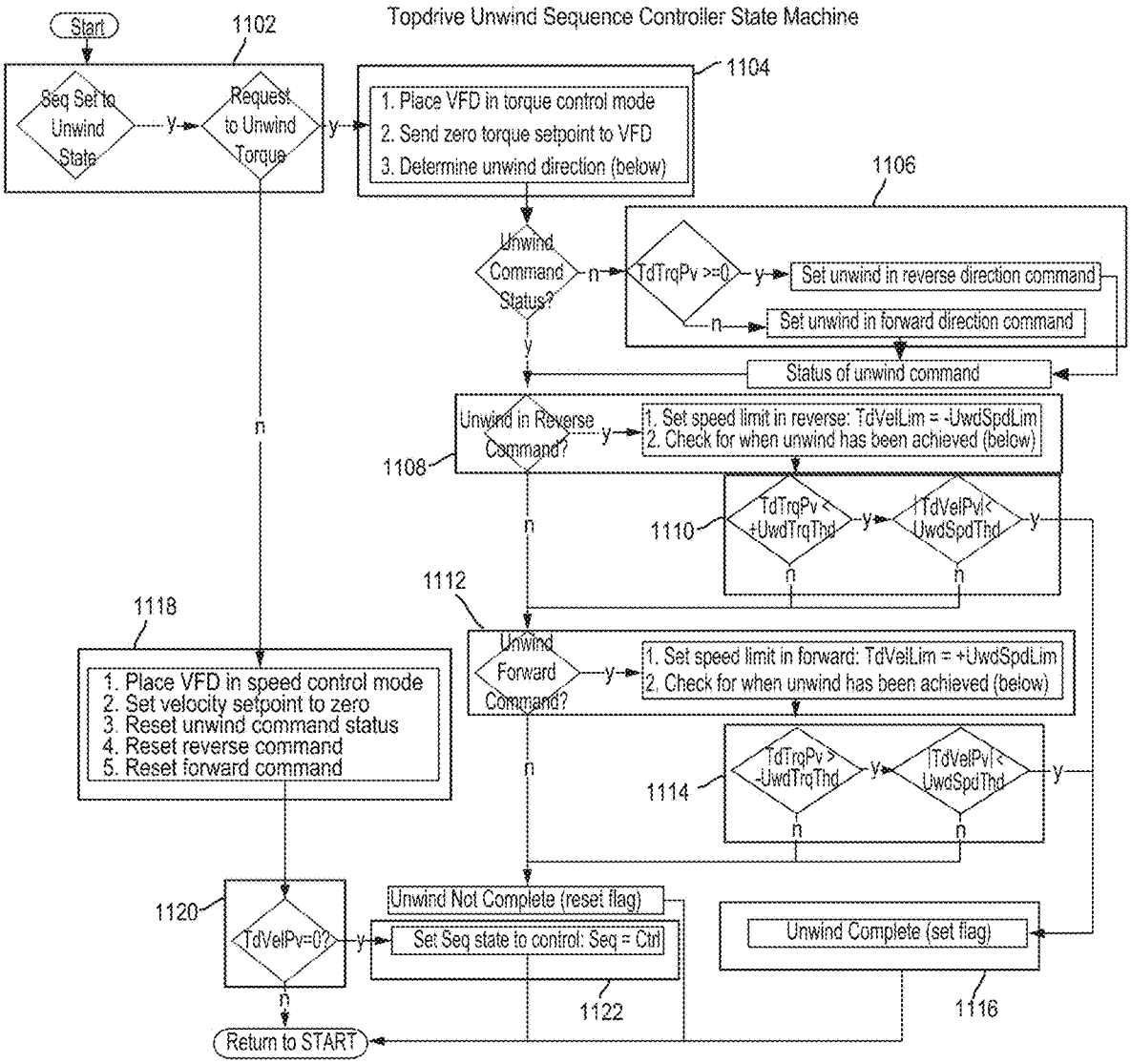

| Abbreviation | Description |
|---|---|
| Seq | Topdrive sequence state |
| Uwd | Unwind state |
| Ctrl | Control state |
| TdTrqPv | Topdrive quillshaft torque feedback |
| TdVelLim | Topdrive velocity limit - while operating in torque |
| TdVelPv | Topdrive quillshaft velocity feedback |
| UwdSpdLim | Unwind speed limit setpoint |
| UwdTrqThd | Unwind torque (complete) threshold |
| UwdSpdThd | Unwind speed (complete) threshold |

FIG. 11A

| Abbreviation | Description |
|---|---|
| Seq | Topdrive sequence state |
| Uwd | Unwind state |
| Ctrl | Control state |
| CtrlVelSp | Control velocity setpoint |
| TdVelPv | Topdrive quillshaft velocity feedback |
| TdVelSp | Topdrive velocity setpoint - while operating in speed control mode. |

| Description | Units | Minimum | Maximum | Value at X1 | Value at X2 |
|---|---|---|---|---|---|
| Dw Elevator Pos [ft] | ft | -3.30 | -0.60 | -1.78 | -0.69 |
| Topdrive Motor Velocity RPM | RPM | -50.0 | 60.0 | 0.0 | 0.0 |
| Quill position [rev] rolls over +/- 8000 | rev | -7495.0... | -7480.0... | -7481.053 | -7486.065 |
| Top Drive Operations State: 0:Fault- 1:Ready- 2:S | EngUnits | 3 | 4 | 4 | 3 |
| Topdrive Vfd - Torque Pv | k-ft-lbs | -50.0 | 20.0 | 12.4 | 0.0 |

SYSTEMS AND METHODS FOR TORQUE UNWIND

CROSS-REFERENCES TO RELATED APPLICATIONS

The present application claims the benefit of U.S. Provisional Application Ser. No. 63/584,419, filed Sep. 21, 2023, and entitled "SYSTEMS AND METHODS FOR TORQUE UNWIND," and U.S. Provisional Application Ser. No. 63/584,430, filed Sep. 21, 2023, and entitled "SYSTEMS AND METHODS FOR TORQUE UNWIND," the contents of which are hereby incorporated by reference in their entirety for all purposes.

BACKGROUND

Drilling a well typically involves a substantial amount of human decision-making during the drilling process. For example, geologists and drilling engineers use their knowledge, experience, and the available information to make decisions on how to plan the drilling operation, how to accomplish the drill plan, and how to handle issues that arise during drilling. However, even the best geologists and drilling engineers perform some guesswork due to the unique nature of each borehole. Furthermore, a directional human driller performing the drilling may have drilled other boreholes in the same region and so may have some similar experience. However, during drilling operations, a multitude of input information and other factors may affect a drilling decision being made by a human operator or specialist, such that the amount of information may overwhelm the cognitive ability of the human to consider and factor into the drilling decision. Furthermore, the quality or the error involved with the drilling decision may improve with larger amounts of input data being considered, for example, such as formation data from a large number of offset wells. For these reasons, human specialists may be unable to achieve optimal drilling decisions, particularly when such drilling decisions are made under time constraints, such as during drilling operations when continuation of drilling is dependent on the drilling decision and, thus, the entire drilling rig waits idly for the next drilling decision. Furthermore, human decision-making for drilling decisions may result in expensive mistakes because drilling errors may add significant cost to drilling operations. In some cases, drilling errors may permanently lower the output of a well, resulting in substantial long term economic losses due to the lost output of the well.

SUMMARY

This disclosure addresses systems and methods for releasing torque from a drill string. In one instance, the method may comprise providing a top drive coupled to a drill string and to a variable frequency drive (VFD), wherein the VFD is adapted to regulate speed and torque of the top drive, and responsive to an indication that torque in the drill string is to be released, stopping operation of the top drive by a control system, determining, by the control system, a direction for rotating the top drive to release the torque in the drill string, determining, by the control system, a speed limit for rotating the top drive to release the torque in the drill string, and rotating the top drive in the direction without exceeding the speed limit determined by the control system until a torque value or speed value falls below a threshold therefor. The method may also include, once the top drive is stopped, the VFD is kept or placed in a second mode, and/or determining, by the control system, a sign of a torque feedback value, and/or determining the direction for rotating the top drive responsive to the sign of the torque feedback value. In addition, the indication that torque in the drill string is to be released may comprise a user input or a determination, by the control system, associated with an anticipated drilling event, and the anticipated drilling event may comprise any one or more of a number of drilling events, including any one or more of the following: a slide drilling operation, a connection of a drill pipe or stand to the drill string, responsive to a mud motor or rotary drilling stall, and torquing a drill pipe or stand against a rotary table or back-up wrench. The method also may include determining a speed limit for rotating the top drive to release the torque comprises receiving a user input associated with a speed limit for rotating the top drive, and the VFD may have a torque control mode and, responsive to the indication that torque in the drill string is to be released, the VFD may be placed into torque control mode, wherein a torque setpoint provided to the VFD is zero and a speed limit setpoint is provided to the VFD. In some or all of the methods described, the torque setpoint may be zero without regard to direction of rotation, and/or a user or the control system may select the speed limit. The control system may be coupled to a user interface that displays a status mode responsive to whether torque in the drill string is to be released or is in a process of being released.

The following disclosure also explains and describes a control system for controlling a release of torque from a drill string during drilling of a wellbore, where the control system may comprise a processor connected to one or more control systems of a drilling rig enabled to drill a borehole, a memory connected to the processor, wherein the memory comprises instructions for performing operations including the following: receiving an indication that torque in a drill string coupled to a top drive is to be released, the top drive coupled to a variable frequency drive (VFD) adapted to regulate speed and torque of the top drive, responsive to the indication, stopping operation of the top drive, determining, by the one or more control systems, a direction for rotating the top drive to release the torque in the drill string, determining, by the one or more control systems, a speed limit for rotating the top drive to release the torque in the drill string, and rotating the top drive in the direction and at the speed limit determined by the one or more control systems until a torque value or speed value falls below a threshold value.

The control system may also allow for, once the top drive is stopped, the VFD being kept or placed in a second mode. The indication that torque in the drill string is to be released may comprise a determination, by the control system, associated with an anticipated drilling event, and the anticipated drilling event may comprises any one or more of a drilling event such as but not limited to the following: a slide drilling operation, a connection of a drill pipe or stand to the drill string, responsive to a mud motor or rotary drilling stall, and torquing a drill pipe or stand against a rotary table or back-up wrench. The control system may be programmed for determining a speed limit for rotating the top drive that may comprise receiving a user input or a control system value associated with a speed limit for rotating the top drive. The VFD may have a torque control mode and, responsive to the indication that torque in the drill string is to be released, the VFD may be placed into torque control mode, wherein a torque setpoint provided to the VFD is zero and a speed limit setpoint is provided to the VFD, and the torque setpoint may be zero without regard to direction of rotation.

The disclosure also includes a method of releasing torque from a drill string, the method comprising receiving an indication to initiate release of torque in a drill string coupled to a top drive, the top drive coupled to a variable frequency drive (VFD) adapted to regulate speed and torque of the top drive, in response to receiving the indication, transitioning the VFD to a torque control mode, setting, via the VFD, a zero torque setpoint, determining a direction for rotating the top drive based at least in part on sign of a torque feedback value, wherein the direction is reverse if the sign is positive, and the direction is forward if the sign is negative, setting, via the VFD, a velocity limit of the top drive to a negative value if the direction is reverse or to a positive value if the direction is forward, rotating the top drive in the determined direction, the VFD regulating the speed based on the velocity limit, determining, when the top drive is rotating in reverse, the torque is released if the torque feedback value of the top drive falls below a torque threshold value and if an absolute value of a velocity feedback value of the top drive is less than a speed threshold value, and determining, when the top drive is rotating in forward, the torque is released if the torque feedback value rises above a negative of the torque threshold value and if the absolute value of the velocity feedback value is less than the speed threshold value.

In still other embodiments, a computer readable medium may be provided with computer software instructions executable on a processor coupled to one or more control systems and/or equipment for drilling a well, with the software instructions executable to perform any or all of the steps of the methods described herein.

Reference to the remaining portions of the specification, including the drawings and claims, may realize other features and advantages of embodiments of the present disclosure. Further features and advantages, as well as the structure and operation of various embodiments of the present disclosure, are described in detail below with respect to the accompanying drawings. In the drawings, like reference numbers may indicate identical or functionally similar elements.

BRIEF DESCRIPTION OF THE DRAWINGS

For a more complete understanding of the present invention and its features and advantages, reference is now made to the following description, taken in conjunction with the accompanying drawings, in which:

FIGS. 11A and 11B is a flowchart of a method for torque unwind, in accordance with embodiments of the present disclosure.

DETAILED DESCRIPTION

Figure 1:
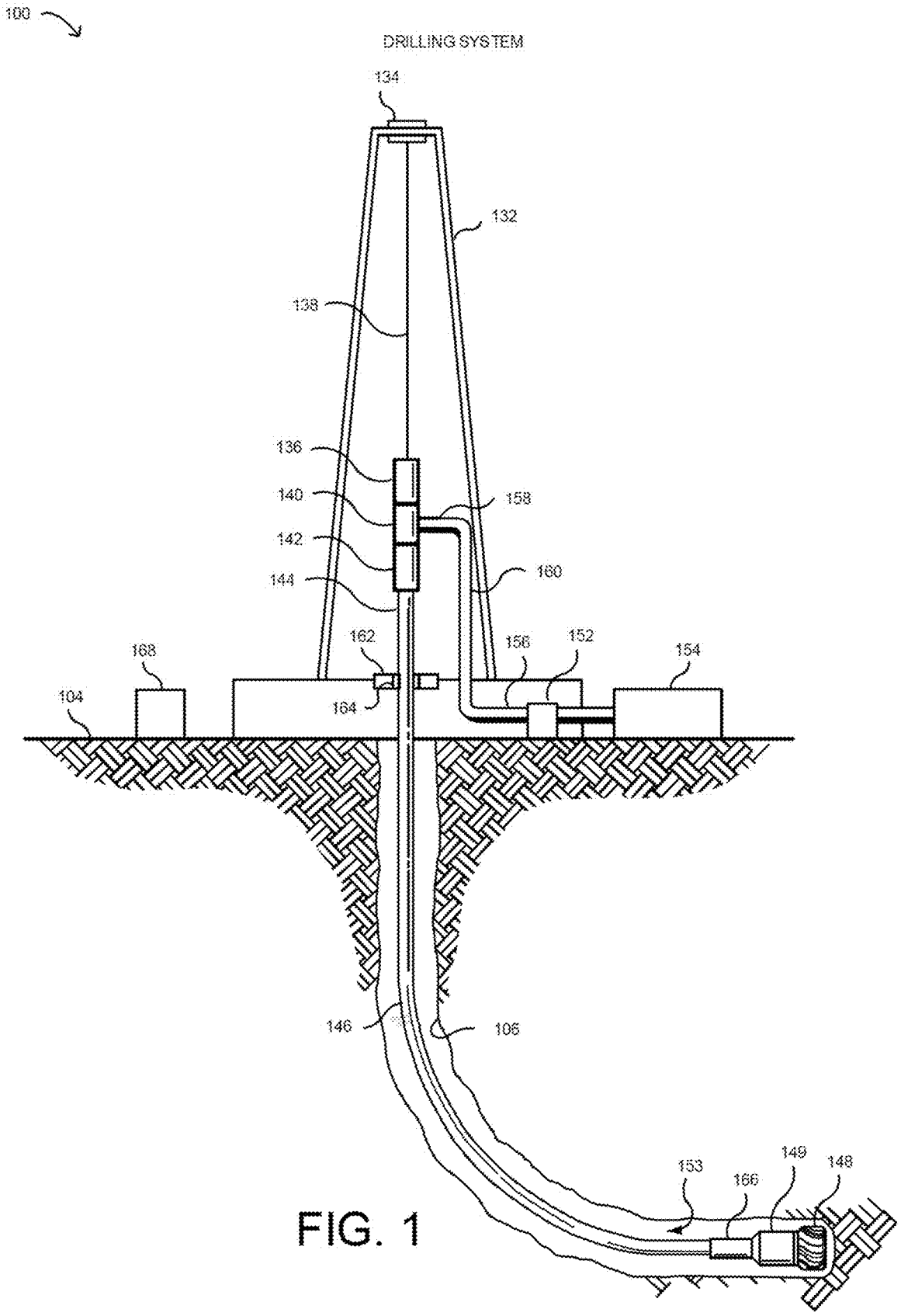
FIG. 1 is a depiction of a drilling system for drilling a borehole, in accordance with embodiments of the present disclosure.

In the following description, details are set forth by way of example to facilitate discussion of the disclosed subject matter. It should be apparent to a person of ordinary skill in the field, however, that the disclosed embodiments are exemplary and not exhaustive of all possible embodiments.

Throughout this disclosure, a hyphenated form of a reference numeral refers to a specific instance of an element and the un-hyphenated form of the reference numeral refers to the element generically or collectively. Thus, as an example (not shown in the drawings), device "12-1" refers to an instance of a device class, which may be referred to collectively as devices "12" and any one of which may be referred to generically as a device "12". In the figures and the description, like numerals are intended to represent like elements.

Drilling a well typically involves a substantial amount of human decision-making during the drilling process. For example, geologists and drilling engineers use their knowledge, experience, and the available information to make decisions on how to plan the drilling operation, how to accomplish the drill plan, and how to handle issues that arise during drilling. However, even the best geologists and drilling engineers perform some guesswork due to the unique nature of each borehole. Furthermore, a directional human driller performing the drilling may have drilled other boreholes in the same region and so may have some similar experience. However, during drilling operations, a multitude of input information and other factors may affect a drilling decision being made by a human operator or specialist, such that the amount of information may overwhelm the cognitive ability of the human to consider and factor into the drilling decision. Furthermore, the quality or the error involved with the drilling decision may improve with larger amounts of input data being considered, for example, such as formation data from a large number of offset wells. For these reasons, human specialists may be unable to achieve optimal drilling decisions, particularly when such drilling decisions are made under time constraints, such as during drilling operations when continuation of drilling is dependent on the drilling decision and, thus, the entire drilling rig waits idly for the next drilling decision. Furthermore, human decision-making for drilling decisions may result in expensive mistakes because drilling errors may add significant cost to drilling operations. In some cases, drilling errors may permanently lower the output of a well, resulting in substantial long term economic losses due to the lost output of the well.

Drilling an oil or gas well may employ a drill string, which under typical conditions experiences many "wraps" of torsional deflection from surface to the drill bit. There are many cases where this torsional deflection must be relieved prior to a subsequent operation. Some examples where torsional deflection must be relieved: Adding new stands of drill pipe to continue drilling, prior to disengaging bottom after a mud-motor stall has been experienced, working out the trapped torque while getting set up for a slide, and after torquing a stand of drill-pipe against the rotary table.

Typically, the driller achieves this by rotating the pipe in the opposite direction to the "trapped" torque until the drill string has unwound (torque has become close to zero). There may be significant variation in how many wraps must be unwound in order to release the torque (energy) stored in the drill string.

Automated drilling processes require this "unwind" process to be managed by the control system. One of the challenges to automating the unwind is knowing how much deflection is in the amount of stored torque. Due to the delays between the rig control system and the variable frequency drive (VFD), unwinding (rotating the drill string in the direction opposite the torque) until the torque has approached zero may result in overshooting, for example but not limited to if too high an unwind speed is selected. Unwinding slowly may avoid the overshoot but is inefficient when many wraps must be relieved. For example, unwinding after making a connection requires (typically) 0.25 wraps to relieve the torque versus 8+ wraps when unwinding 20,000 ft of drill-pipe.

One solution to solve the overshoot problem is to put the VFD into "torque control" mode. Most VFD manufacturers provide two control modes: Speed Mode and Torque Mode (sometimes referred to in this disclosure as speed control mode and torque control mode, respectively, or like terms). In speed control mode, the user or control system provides the VFD with a desired speed setpoint and torque limit. The VFD regulates torque to achieve that speed up to the torque limit. In torque control mode, the user or control system provides the VFD with a desired torque setpoint and speed limit. The VFD applies the torque setpoint. If the speed exceeds the speed limit, the VFD regulates the torque.

For drilling processes, the VFD Speed Mode is utilized, where providing speed regulation within a given torque limit is the objective. For the torque unwind process, employing Torque Mode in the VFD allows the control system to request "zero" torque with a speed limit that the VFD imposes. Since the VFD has high bandwidth control of the motor, the overshooting issue associated with the variability of the torque and unwind wraps magnitude is avoided. This mode is used for applications where applying or maintaining a level of torque within a given speed range is the objective.

While regulating the top drive during drilling operations, if an unwind is commanded within the control system the following steps may be taken: the top drive may be stopped in Speed Mode. Once stopped, the control system may be placed into Torque Mode with a zero-torque reference. The sign of the torque feedback (e.g. positive or negative) may then be used to determine the direction to configure the speed limit control. A positive torque feedback may indicate that to release torque the top drive may rotate in a reverse direction thus the speed limit may be applied in a reverse rotation direction. A negative torque feedback may indicate that to release torque the top drive may rotate in a forward direction thus the speed limit may be applied to the forward rotation direction. Once the torque and speed fall below threshold values, the control system may raise a flag indicating that the unwind has completed.

While in Torque Mode for unwinding, if the command to unwind is removed, the following steps may be taken: The top drive may be placed into Speed Mode with a zero velocity setpoint to stop all top drive rotation. Once motion has stopped, the top drive mode may be transitioned to resume alternative drilling rig operations.

The systems and methods used to drill oil and gas wells are complex and sophisticated. Methods and systems developed for oil and gas wells may be adapted for use in planning, drilling, and creating wells for geothermal energy. The following discussion provides a description of systems and techniques for drilling wells that may be useful for drilling geothermal wells, as well as generating electricity therefrom.

Referring now to the drawings, Referring to FIG. 1, a drilling system 100 is illustrated in one embodiment as a top drive system. As shown, the drilling system 100 includes a derrick 132 on the surface 104 of the earth and is used to drill a borehole 106 into the earth. Typically, drilling system 100 is used at a location corresponding to a geographic formation 102 in the earth that is known.

In FIG. 1, derrick 132 includes a crown block 134 to which a traveling block 136 is coupled via a drilling line 138. In drilling system 100, a top drive 140 is coupled to traveling block 136 and may provide rotational force for drilling. A saver sub 142 may sit between the top drive 140 and a drill pipe 144 that is part of a drill string 146. Top drive 140 may rotate drill string 146 via the saver sub 142, which in turn may rotate a drill bit 148 of a bottom hole assembly (BHA) 149 in borehole 106 passing through formation 102. Also visible in drilling system 100 is a rotary table 162 that may be fitted with a master bushing 164 to hold drill string 146 when not rotating.

A mud pump 152 may direct a fluid mixture (e.g., drilling mud 153) from a mud pit 154 into drill string 146. Mud pit 154 is shown schematically as a container, but it is noted that various receptacles, tanks, pits, or other containers may be used. Drilling mud 153 may flow from mud pump 152 into a discharge line 156 that is coupled to a rotary hose 158 by a standpipe 160. Rotary hose 158 may then be coupled to top drive 140, which includes a passage for drilling mud 153 to flow into borehole 106 via drill string 146 from where drilling mud 153 may emerge at drill bit 148. Drilling mud 153 may lubricate drill bit 148 during drilling and, due to the pressure supplied by mud pump 152, drilling mud 153 may return via borehole 106 to surface 104.

In drilling system 100, drilling equipment (see also FIG. 5) is used to perform the drilling of borehole 106, such as top drive 140 (or rotary drive equipment) that couples to drill string 146 and BHA 149 and is configured to rotate drill string 146 and apply pressure to drill bit 148. Drilling system 100 may include control systems such as a WOB/differential pressure control system 522, a positional/rotary control system 524, a fluid circulation control system 526, and a sensor system 528, as further described below with respect to FIG. 5. The control systems may be used to monitor and change drilling rig settings, such as the WOB or differential pressure to alter the ROP or the radial orientation of the toolface, change the flow rate of drilling mud, and perform other operations. Sensor system 528 may be for obtaining sensor data about the drilling operation and drilling system 100, including the downhole equipment. For example, sensor system 528 may include MWD or logging while drilling (LWD) tools for acquiring information, such as toolface and formation logging information, which may be saved for later retrieval, transmitted with or without a delay using any of various communication means (e.g., wireless, wireline, or mud pulse telemetry), or otherwise transferred to steering control system 168. As used herein, an MWD tool is enabled to communicate downhole measurements without substantial delay to the surface 104, such as using mud pulse telemetry, while a LWD tool is equipped with an internal memory that stores measurements when downhole and may be used to download a stored log of measurements when the LWD tool is at the surface 104. The internal memory in the LWD tool may be a removable memory, such as a universal serial bus (USB) memory device or another removable memory device. It is noted that certain downhole tools may have both MWD and LWD capabilities. Such information acquired by sensor system 528 may include information related to hole depth, bit depth, inclination angle, azimuth angle, true vertical depth, gamma count, standpipe pressure, mud flow rate, rotary rotations per minute (RPM), bit speed, ROP, WOB, among other information. It is noted that all or part of sensor system 528 may be incorporated into a control system, or in another component of the drilling equipment. As drilling system 100 may be configured in many different implementations, it is noted that different control systems and subsystems may be used.

Sensing, detection, measurement, evaluation, storage, alarm, and other functionality may be incorporated into a downhole tool 166 or BHA 149 or elsewhere along drill string 146 to provide downhole surveys of borehole 106. Accordingly, downhole tool 166 may be an MWD tool or a LWD tool or both, and may accordingly utilize connectivity to the surface 104, local storage, or both. In different implementations, gamma radiation sensors, magnetometers, accelerometers, and other types of sensors may be used for the downhole surveys. Although downhole tool 166 is shown in singular in drilling system 100, it is noted that multiple instances (not shown) of downhole tool 166 may be located at one or more locations along drill string 146.

In some embodiments, formation detection and evaluation functionality may be provided via a steering control system 168 on the surface 104. Steering control system 168 may be located in proximity to derrick 132 or may be included with drilling system 100. In other embodiments, steering control system 168 may be remote from the actual location of borehole 106 (see also FIG. 4). For example, steering control system 168 may be a stand-alone system or may be incorporated into other systems included with drilling system 100.

In operation, steering control system 168 may be accessible via a communication network (see also FIG. 10) and may accordingly receive formation information via the communication network. In some embodiments, steering control system 168 may use the evaluation functionality to provide corrective measures, such as a convergence plan to overcome an error in the well trajectory of borehole 106 with respect to a reference, or a planned well trajectory. The convergence plans or other corrective measures may depend on a determination of the well trajectory, and therefore, may be improved in accuracy using certain methods and systems for improved drilling performance.

In particular embodiments, at least a portion of steering control system 168 may be located in downhole tool 166 (not shown). In some embodiments, steering control system 168 may communicate with a separate controller (not shown) located in downhole tool 166. In particular, steering control system 168 may receive and process measurements received from downhole surveys and may perform the calculations described herein using the downhole surveys and other information referenced herein.

In drilling system 100, to aid in the drilling process, data is collected from borehole 106, such as from sensors in BHA 149, downhole tool 166, or both. The collected data may include the geological characteristics of formation 102 in which borehole 106 was formed, the attributes of drilling system 100, including BHA 149, and drilling information such as weight-on-bit (WOB), drilling speed, and other information pertinent to the formation of borehole 106. The drilling information may be associated with a particular depth or another identifiable marker to index collected data. For example, the collected data for borehole 106 may capture drilling information indicating that drilling of the well from 1,000 feet to 1,200 feet occurred at a first rate of penetration (ROP) through a first rock layer with a first WOB, while drilling from 1,200 feet to 1,500 feet occurred at a second ROP through a second rock layer with a second WOB (see also FIG. 2). In some applications, the collected data may be used to virtually recreate the drilling process that created borehole 106 in formation 102, such as by displaying a computer simulation of the drilling process. The accuracy with which the drilling process may be recreated depends on a level of detail and accuracy of the collected data, including collected data from a downhole survey of the well trajectory.

The collected data may be stored in a database that is accessible via a communication network for example. In some embodiments, the database storing the collected data for borehole 106 may be located locally at drilling system 100, at a drilling hub that supports a plurality of drilling systems 100 in a region, or at a database server accessible over the communication network that provides access to the database (see also FIG. 4). At drilling system 100, the collected data may be stored at the surface 104 or downhole in drill string 146, such as in a memory device included with BHA 149 (see also FIG. 10). Alternatively, at least a portion of the collected data may be stored on a removable storage medium, such as using steering control system 168 or BHA 149, which is later coupled to the database in order to transfer the collected data to the database, which may be manually performed at certain intervals, for example.

In FIG. 1, steering control system 168 is located at or near the surface 104 where borehole 106 is being drilled. Steering control system 168 may be coupled to equipment used in drilling system 100 and may also be coupled to the database, whether the database is physically located locally, regionally, or centrally (see also FIGS. 4 and 5). Accordingly, steering control system 168 may collect and record various inputs, such as measurement data from a magnetometer and an accelerometer that may also be included with BHA 149.

Steering control system 168 may further be used as a surface steerable system, along with the database, as described above. The surface steerable system may enable an operator to plan and control drilling operations while drilling is being performed. The surface steerable system may itself also be used to perform certain drilling operations, such as controlling certain control systems that, in turn, control the actual equipment in drilling system 100 (see also FIG. 5). The control of drilling equipment and drilling operations by steering control system 168 may be manual, manual-assisted, semi-automatic, or automatic, in different embodiments.

Manual control may involve direct control of the drilling rig equipment, albeit with certain safety limits to prevent unsafe or undesired actions or collisions of different equipment. To enable manual-assisted control, steering control system 168 may present various information, such as using a graphical user interface (GUI) displayed on a display device (see FIG. 8), to a human operator, and may provide controls that enable the human operator to perform a control operation. The information presented to the user may include live measurements and feedback from the drilling rig and steering control system 168, or the drilling rig itself, and may further include limits and safety-related elements to prevent unwanted actions or equipment states, in response to a manual control command entered by the user using the GUI.

To implement semi-automatic control, steering control system 168 may itself propose or indicate to the user, such as via the GUI, that a certain control operation, or a sequence of control operations, should be performed at a given time. Then, steering control system 168 may enable the user to imitate the indicated control operation or sequence of control operations, such that once manually started, the indicated control operation or sequence of control operations is automatically completed. The limits and safety features mentioned above for manual control would still apply for semi-automatic control. It is noted that steering control system 168 may execute semi-automatic control using a secondary processor, such as an embedded controller that executes under a real-time operating system (RTOS), that is under the control and command of steering control system 168. To implement automatic control, the step of manual starting the indicated control operation or sequence of operations is eliminated, and steering control system 168 may proceed with only a passive notification to the user of the actions taken.

In order to implement various control operations, steering control system 168 may perform (or may cause to be performed) various input operations, processing operations, and output operations. The input operations performed by steering control system 168 may result in measurements or other input information being made available for use in any subsequent operations, such as processing or output operations. The input operations may accordingly provide the input information, including feedback from the drilling process itself, to steering control system 168. The processing operations performed by steering control system 168 may be any processing operation, as disclosed herein. The output operations performed by steering control system 168 may involve generating output information for use by external entities, or for output to a user, such as in the form of updated elements in the GUI, for example. The output information may include at least some of the input information, enabling steering control system 168 to distribute information among various entities and processors.

In particular, the operations performed by steering control system 168 may include operations such as receiving drilling data representing a drill path, receiving other drilling parameters, calculating a drilling solution for the drill path based on the received data and other available data (e.g., rig characteristics), implementing the drilling solution at the drilling rig, monitoring the drilling process to gauge whether the drilling process is within a defined margin of error of the drill path, and calculating corrections for the drilling process if the drilling process is outside of the margin of error.

Accordingly, steering control system 168 may receive input information either before drilling, during drilling, or after drilling of borehole 106. The input information may comprise measurements from one or more sensors, as well as survey information collected while drilling borehole 106. The input information may also include a drill plan, a regional formation history, drilling engineer parameters, downhole toolface/inclination information, downhole tool gamma/resistivity information, economic parameters, and reliability parameters, among various other parameters. Some of the input information, such as the regional formation history, may be available from a drilling hub 410, which may have respective access to a regional drilling database (DB) 412 (see FIG. 4). Other input information may be accessed or uploaded from other sources to steering control system 168. For example, a web interface may be used to interact directly with steering control system 168 to upload the drill plan or drilling parameters.

As noted, the input information may be provided to steering control system 168. After processing by steering control system 168, steering control system 168 may generate control information that may be output to drilling rig 210 (e.g., to rig controls 520 that control drilling equipment 530, see also FIGS. 2 and 5). Drilling rig 210 may provide feedback information using rig controls 520 to steering control system 168. The feedback information may then serve as input information to steering control system 168, thereby enabling steering control system 168 to perform feedback loop control and validation. Accordingly, steering control system 168 may be configured to modify its output information to the drilling rig, in order to achieve the desired results, which are indicated in the feedback information. The output information generated by steering control system 168 may include indications to modify one or more drilling parameters, the direction of drilling, and the drilling mode, among others. In certain operational modes, such as semi-automatic or automatic, steering control system 168 may generate output information indicative of instructions to rig controls 520 to enable automatic drilling using the latest location of BHA 149. Therefore, an improved accuracy in the determination of the location of BHA 149 may be provided using steering control system 168.

Figure 2:
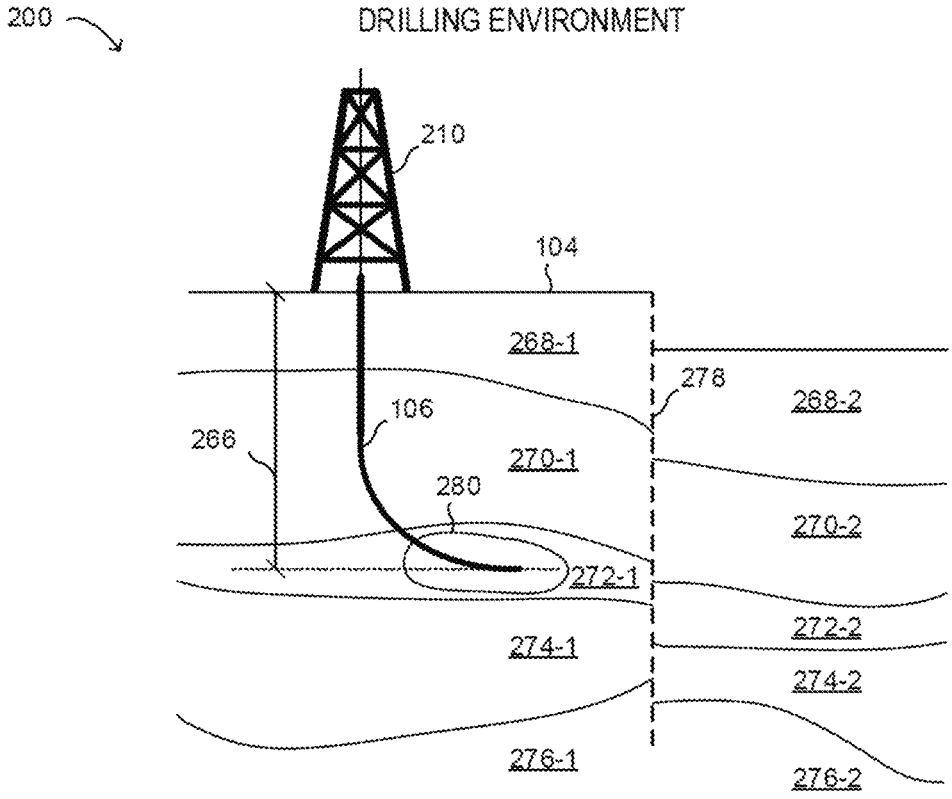
FIG. 2 is a depiction of a drilling environment including the drilling system for drilling a borehole, in accordance with embodiments of the present disclosure.

Referring now to FIG. 2, a drilling environment 200 is depicted schematically and is not drawn to scale or perspective. In particular, drilling environment 200 may illustrate additional details with respect to formation 102 below the surface 104 in drilling system 100 shown in FIG. 1. In FIG. 2, drilling rig 210 may represent various equipment discussed above with respect to drilling system 100 in FIG. 1 that is located at the surface 104.

In drilling environment 200, it may be assumed that a drill plan (also referred to as a well plan) has been formulated to drill borehole 106 extending into the ground to a true vertical depth (TVD) 266 and penetrating several subterranean strata layers. Borehole 106 is shown in FIG. 2 extending through strata layers 268-1 and 270-1, while terminating in strata layer 272-1. Accordingly, as shown, borehole 106 does not extend or reach underlying strata layers 274-1 and 276-1. A target area 280 specified in the drill plan may be located in strata layer 272-1 as shown in FIG. 2. Target area 280 may represent a desired endpoint of borehole 106, such as a hydrocarbon producing area indicated by strata layer 272-1. It is noted that target area 280 may be of any shape and size and may be defined using various different methods and information in different embodiments. In some instances, target area 280 may be specified in the drill plan using subsurface coordinates, or references to certain markers, which indicate where borehole 106 is to be terminated. In other instances, target area may be specified in the drill plan using a depth range within which borehole 106 is to remain. For example, the depth range may correspond to strata layer 272-1. In other examples, target area 280 may extend as far as may be realistically drilled. For example, when borehole 106 is specified to have a horizontal section with a goal to extend into strata layer 172 as far as possible, target area 280 may be defined as strata layer 272-1 itself and drilling may continue until some other physical limit is reached, such as a property boundary or a physical limitation to the length of the drill string.

Also visible in FIG. 2 is a fault line 278 that has resulted in a subterranean discontinuity in the fault structure. Specifically, strata layers 268, 270, 272, 274, and 276 have portions on either side of fault line 278. On one side of fault line 278, where borehole 106 is located, strata layers 268-1, 270-1, 272-1, 274-1, and 276-1 are unshifted by fault line 278. On the other side of fault line 278, strata layers 268-2, 270-3, 272-3, 274-3, and 276-3 are shifted downwards by fault line 278.

Current drilling operations frequently include directional drilling to reach a target, such as target area 280. The use of directional drilling has been found to generally increase an overall amount of production volume per well, but also may lead to significantly higher production rates per well, which are both economically desirable. As shown in FIG. 2, directional drilling may be used to drill the horizontal portion of borehole 106, which increases an exposed length of borehole 106 within strata layer 272-1, and which may accordingly be beneficial for hydrocarbon extraction from strata layer 272-1. Directional drilling may also be used alter an angle of borehole 106 to accommodate subterranean faults, such as indicated by fault line 278 in FIG. 2. Other benefits that may be achieved using directional drilling include sidetracking off of an existing well to reach a different target area or a missed target area, drilling around abandoned drilling equipment, drilling into otherwise inaccessible or difficult to reach locations (e.g., under populated areas or bodies of water), providing a relief well for an existing well, and increasing the capacity of a well by branching off and having multiple boreholes extending in different directions or at different vertical positions for the same well. Directional drilling is often not limited to a straight horizontal borehole 106 but may involve staying within a strata layer that varies in depth and thickness as illustrated by strata layer 172. As such, directional drilling may involve multiple vertical adjustments that complicate the trajectory of borehole 106.

Figure 3:
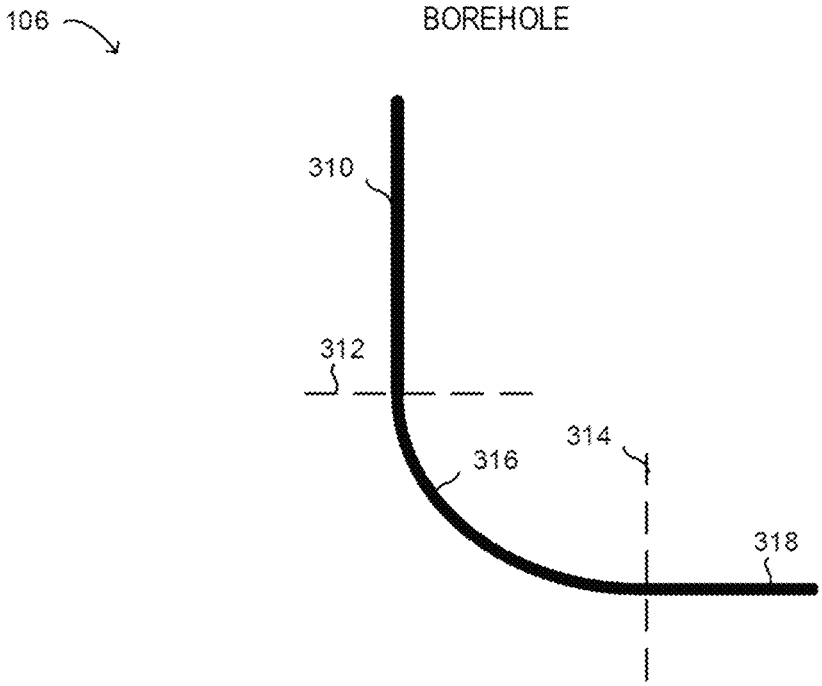
FIG. 3 is a depiction of a borehole generated in the drilling environment, in accordance with embodiments of the present disclosure.

Referring now to FIG. 3, one embodiment of a portion of borehole 106 is shown in further detail. Using directional drilling for horizontal drilling may introduce certain challenges or difficulties that may not be observed during vertical drilling of borehole 106. For example, a horizontal portion 318 of borehole 106 may be started from a vertical portion 310. In order to make the transition from vertical to horizontal, a curve may be defined that specifies a so-called "build up" section 316. Build up section 316 may begin at a kickoff point 312 in vertical portion 310 and may end at a begin point 314 of horizontal portion 318. The change in inclination in buildup section 316 per measured length drilled is referred to herein as a "build rate" and may be defined in degrees per one hundred feet drilled. For example, the build rate may have a value of 6°/100 ft., indicating that there is a six-degree change in inclination for everyone hundred feet drilled. The build rate for a particular build up section may remain relatively constant or may vary.

The build rate used for any given build up section may depend on various factors, such as properties of the formation (i.e., strata layers) through which borehole 106 is to be drilled, the trajectory of borehole 106, the particular pipe and drill collars/BHA components used (e.g., length, diameter, flexibility, strength, mud motor bend setting, and drill bit), the mud type and flow rate, the specified horizontal displacement, stabilization, and inclination, among other factors. An overly aggressive built rate may cause problems such as severe doglegs (e.g., sharp changes in direction in the borehole) that may make it difficult or impossible to run casing or perform other operations in borehole 106. Depending on the severity of any mistakes made during directional drilling, borehole 106 may be enlarged or drill bit 146 may be backed out of a portion of borehole 106 and redrilled along a different path. Such mistakes may be undesirable due to the additional time and expense involved. However, if the built rate is too cautious, additional overall time may be added to the drilling process because directional drilling generally involves a lower ROP than straight drilling. Furthermore, directional drilling for a curve is more complicated than vertical drilling and the possibility of drilling errors increases with directional drilling (e.g., overshoot and undershoot that may occur while trying to keep drill bit 148 on the planned trajectory).

Two modes of drilling, referred to herein as "rotating" and "sliding," are commonly used to form a borehole 106. Rotating, also called "rotary drilling," uses top drive 140 or rotary table 162 to rotate drill string 146. Rotating may be used when drilling occurs along a straight trajectory, such as for vertical portion 310 of borehole 106. Sliding, also called "steering" or "directional drilling" as noted above, typically uses a mud motor located downhole at BHA 149. The mud motor may have an adjustable bent housing and is not powered by rotation of the drill string 146. Instead, the mud motor uses hydraulic power derived from the pressurized drilling mud that circulates along borehole 106 to and from the surface 104 to directionally drill borehole 106 in buildup section 316.

Thus, sliding is used in order to control the direction of the well trajectory during directional drilling. A method to perform a slide may include the following operations. First, during vertical or straight drilling, the rotation of drill string 146 is stopped. Based on feedback from measuring equipment, such as from downhole tool 166, adjustments may be made to drill string 146, such as using top drive 140 to apply various combinations of torque, WOB, and vibration, among other adjustments. The adjustments may continue until a toolface is confirmed that indicates a direction of the bend of the mud motor is oriented to a direction of a desired deviation (i.e., build rate) of borehole 106. Once the desired orientation of the mud motor is attained, WOB to the drill bit is increased, which causes the drill bit to move in the desired direction of deviation. Once sufficient distance and angle have been built up in the curved trajectory, a transition back to rotating mode may be accomplished by rotating the drill string 146 again. The rotation of the drill string 146 after sliding may neutralize the directional deviation caused by the bend in the mud motor due to the continuous rotation around a centerline of borehole 106.

Figure 4:
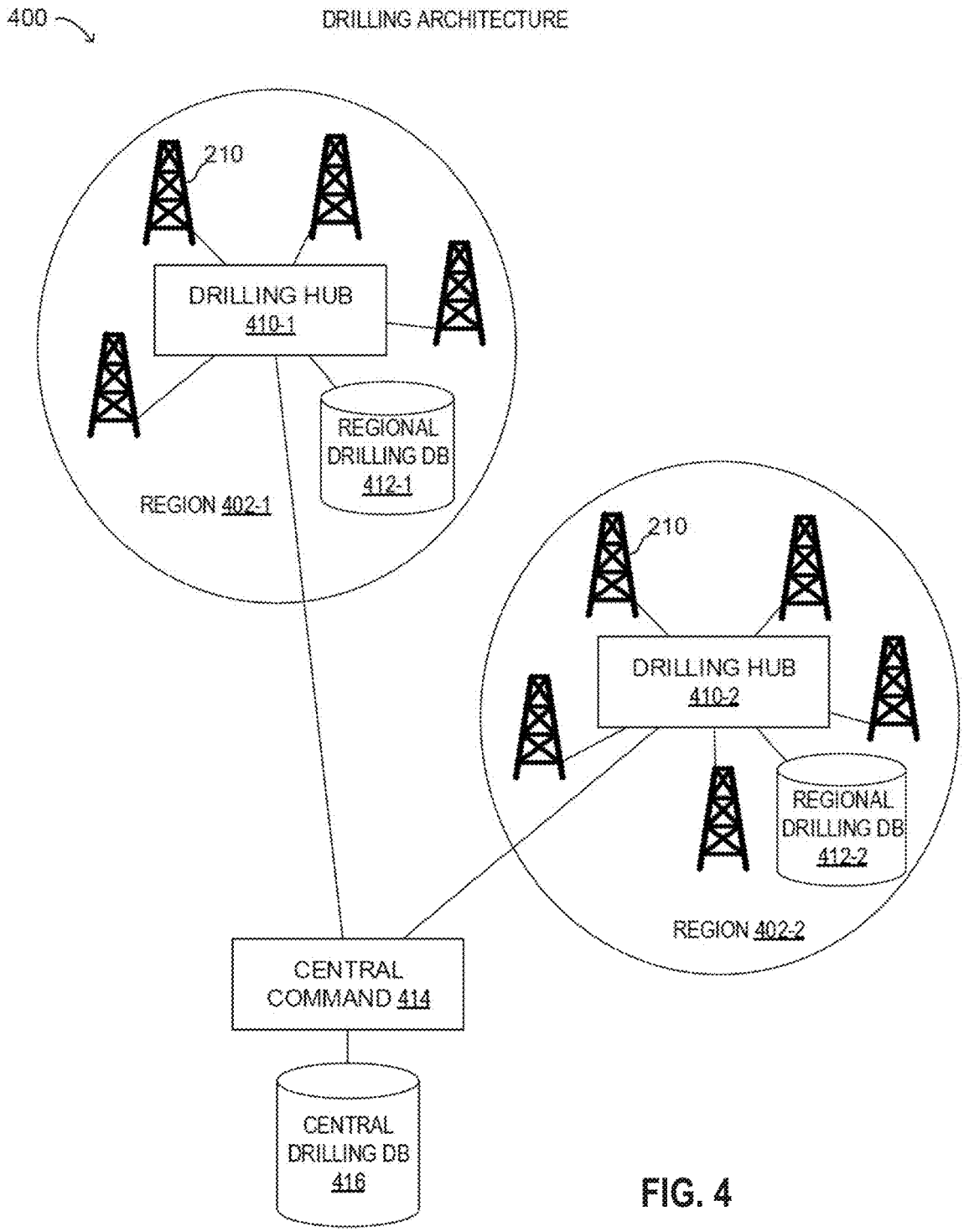
FIG. 4 is a depiction of a drilling architecture including the drilling environment, in accordance with embodiments of the present disclosure.

Referring now to FIG. 4, a drilling architecture 400 is illustrated in diagram form. As shown, drilling architecture 400 depicts a hierarchical arrangement of drilling hubs 410 and a central command 414, to support the operation of a plurality of drilling rigs 210 in different regions 402. Specifically, as described above with respect to FIGS. 1 and 2, drilling rig 210 includes steering control system 168 that is enabled to perform various drilling control operations locally to drilling rig 210. When steering control system 168 is enabled with network connectivity, certain control operations or processing may be requested or queried by steering control system 168 from a remote processing resource. As shown in FIG. 4, drilling hubs 410 represent a remote processing resource for steering control system 168 located at respective regions 402, while central command 414 may represent a remote processing resource for both drilling hub 410 and steering control system 168.

Specifically, in a region 401-1, a drilling hub 410-1 may serve as a remote processing resource for drilling rigs 210 located in region 401-1, which may vary in number and are not limited to the exemplary schematic illustration of FIG. 4. Additionally, drilling hub 410-1 may have access to a regional drilling DB 412-1, which may be local to drilling hub 410-1. Additionally, in a region 401-2, a drilling hub 410-2 may serve as a remote processing resource for drilling rigs 210 located in region 401-2, which may vary in number and are not limited to the exemplary schematic illustration of FIG. 4. Additionally, drilling hub 410-2 may have access to a regional drilling DB 412-2, which may be local to drilling hub 410-2.

In FIG. 4, respective regions 402 may exhibit the same or similar geological formations. Thus, reference wells, or offset wells, may exist in a vicinity of a given drilling rig 210 in region 402, or where a new well is planned in region 402. Furthermore, multiple drilling rigs 210 may be actively drilling concurrently in region 402 and may be in various stages of drilling through the depths of formation strata layers at region 402. Thus, for any given well being drilled by drilling rig 210 in a region 402, survey data from the reference wells or offset wells may be used to create the drill plan and may be used for improved drilling performance. In some implementations, survey data or reference data from a plurality of reference wells may be used to improve drilling performance, such as by reducing an error in estimating TVD or a position of BHA 149 relative to one or more strata layers, as may be described in further detail herein. Additionally, survey data from recently drilled wells, or wells still currently being drilled, including the same well, may be used for reducing an error in estimating TVD or a position of BHA 149 relative to one or more strata layers.

Also shown in FIG. 4 is central command 414, which has access to central drilling DB 416, and may be located at a centralized command center that is in communication with drilling hubs 410 and drilling rigs 210 in various regions 402. The centralized command center may have the ability to monitor drilling and equipment activity at any one or more drilling rigs 210. In some embodiments, central command 414 and drilling hubs 412 may be operated by a commercial operator of drilling rigs 210 as a service to customers who have hired the commercial operator to drill wells and provide other drilling-related services.

In FIG. 4, it is particularly noted that central drilling DB 416 may be a central repository that is accessible to drilling hubs 410 and drilling rigs 210. Accordingly, central drilling DB 416 may store information for various drilling rigs 210 in different regions 402. In some embodiments, central drilling DB 416 may serve as a backup for at least one regional drilling DB 412 or may otherwise redundantly store information that is also stored on at least one regional drilling DB 412. In turn, regional drilling DB 412 may serve as a backup or redundant storage for at least one drilling rig 210 in region 402. For example, regional drilling DB 412 may store information collected by steering control system 168 from drilling rig 210.

In some embodiments, the formulation of a drill plan for drilling rig 210 may include processing and analyzing the collected data in regional drilling DB 412 to create a more effective drill plan. Furthermore, once the drilling has begun, the collected data may be used in conjunction with current data from drilling rig 210 to improve drilling decisions. As noted, the functionality of steering control system 168 may be provided at drilling rig 210, or may be provided, at least in part, at a remote processing resource, such as drilling hub 410 or central command 414.

As noted, steering control system 168 may provide functionality as a surface steerable system for controlling drilling rig 210. Steering control system 168 may have access to regional drilling DB 412 and central drilling DB 416 to provide the surface steerable system functionality. As may be described in greater detail below, steering control system 168 may be used to plan and control drilling operations based on input information, including feedback from the drilling process itself. Steering control system 168 may be used to perform operations such as receiving drilling data representing a drill trajectory and other drilling parameters, calculating a drilling solution for the drill trajectory based on the received data and other available data (e.g., rig characteristics), implementing the drilling solution at drilling rig 210, monitoring the drilling process to gauge whether the drilling process is within a margin of error that is defined for the drill trajectory, or calculating corrections for the drilling process if the drilling process is outside of the margin of error.

Figure 5:
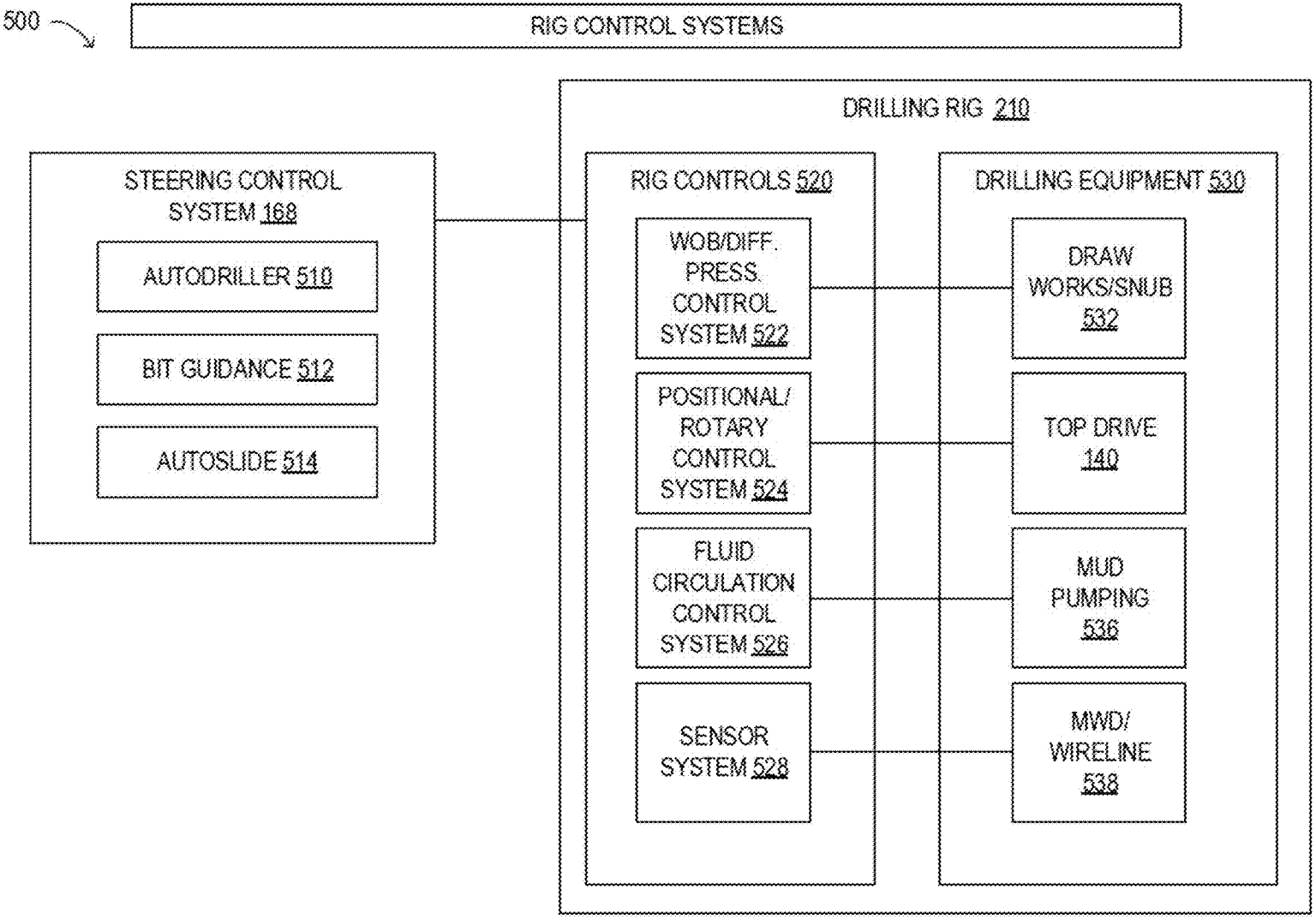
FIG. 5 is a depiction of rig control systems included in the drilling system, in accordance with embodiments of the present disclosure.

Referring now to FIG. 5, an example of rig control systems 500 is illustrated in schematic form. It is noted that rig control systems 500 may include fewer or more elements than shown in FIG. 5 in different embodiments. As shown, rig control systems 500 includes steering control system 168 and drilling rig 210. Specifically, steering control system 168 is shown with logical functionality including an autodriller 510, a bit guidance 512, and an autoslide 514. Drilling rig 210 is hierarchically shown including rig controls 520, which provide secure control logic and processing capability, along with drilling equipment 530, which represents the physical equipment used for drilling at drilling rig 210. As shown, rig controls 520 include WOB/differential pressure control system 522, positional/rotary control system 524, fluid circulation control system 526, and sensor system 528, while drilling equipment 530 includes a draw works/snub 532, top drive 140, mud pumping equipment 536, and MWD/wireline equipment 538.

Figure 10:
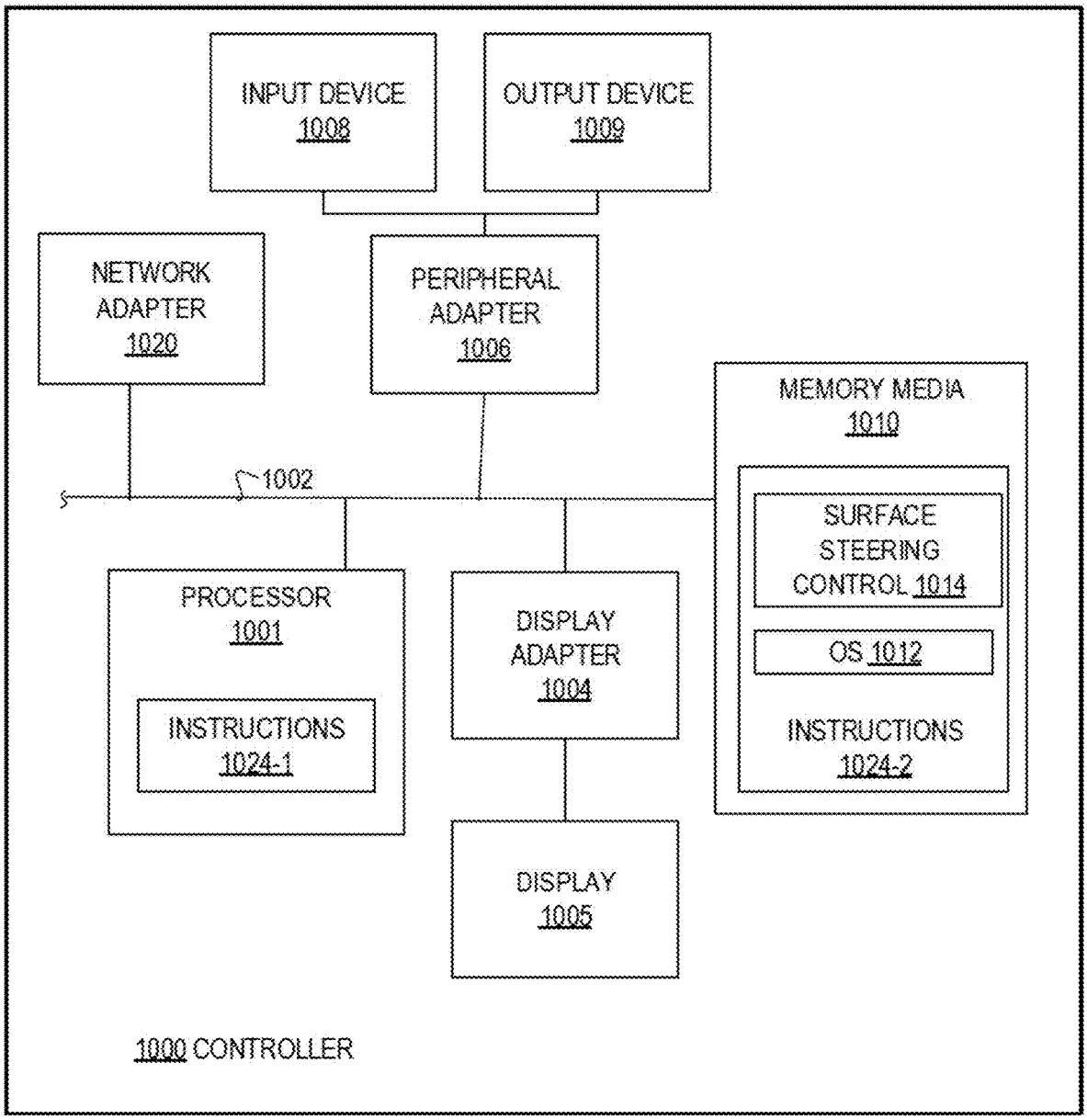
FIG. 10 is a depiction of a controller usable by the rig control systems, in accordance with embodiments of the present disclosure.

Steering control system 168 represent an instance of a processor having an accessible memory storing instructions executable by the processor, such as an instance of controller 1000 shown in FIG. 10. Also, WOB/differential pressure control system 522, positional/rotary control system 524, and fluid circulation control system 526 may each represent an instance of a processor having an accessible memory storing instructions executable by the processor, such as an instance of controller 1000 shown in FIG. 10, but for example, in a configuration as a programmable logic controller (PLC) that may not include a user interface but may be used as an embedded controller. Accordingly, it is noted that each of the systems included in rig controls 520 may be a separate controller, such as a PLC, and may autonomously operate, at least to a degree. Steering control system 168 may represent hardware that executes instructions to implement a surface steerable system that provides feedback and automation capability to an operator, such as a driller. For example, steering control system 168 may cause autodriller 510, bit guidance 512 (also referred to as a bit guidance system (BGS)), and autoslide 514 (among others, not shown) to be activated and executed at an appropriate time during drilling. In particular implementations, steering control system 168 may be enabled to provide a user interface during drilling, such as the user interface 850 depicted and described below with respect to FIG. 8. Accordingly, steering control system 168 may interface with rig controls 520 to facilitate manual, assisted manual, semi-automatic, and automatic operation of drilling equipment 530 included in drilling rig 210. It is noted that rig controls 520 may also accordingly be enabled for manual or user-controlled operation of drilling and may include certain levels of automation with respect to drilling equipment 530.

In rig control systems 500 of FIG. 5, WOB/differential pressure control system 522 may be interfaced with draw works/snubbing unit 532 to control WOB of drill string 146. Positional/rotary control system 524 may be interfaced with top drive 140 to control rotation of drill string 146. Fluid circulation control system 526 may be interfaced with mud pumping equipment 536 to control mud flow and may also receive and decode mud telemetry signals. Sensor system 528 may be interfaced with MWD/wireline equipment 538, which may represent various BHA sensors and instrumentation equipment, among other sensors that may be downhole or at the surface.

In rig control systems 500, autodriller 510 may represent an automated rotary drilling system and may be used for controlling rotary drilling. Accordingly, autodriller 510 may enable automate operation of rig controls 520 during rotary drilling, as indicated in the drill plan. Bit guidance 512 may represent an automated control system to monitor and control performance and operation drilling bit 148.

In rig control systems 500, autoslide 514 may represent an automated slide drilling system and may be used for controlling slide drilling. Accordingly, autoslide 514 may enable automate operation of rig controls 520 during a slide and may return control to steering control system 168 for rotary drilling at an appropriate time, as indicated in the drill plan. In particular implementations, autoslide 514 may be enabled to provide a user interface during slide drilling to specifically monitor and control the slide. For example, autoslide 514 may rely on bit guidance 512 for orienting a toolface and on autodriller 510 to set WOB or control rotation or vibration of drill string 146.

Figure 6:
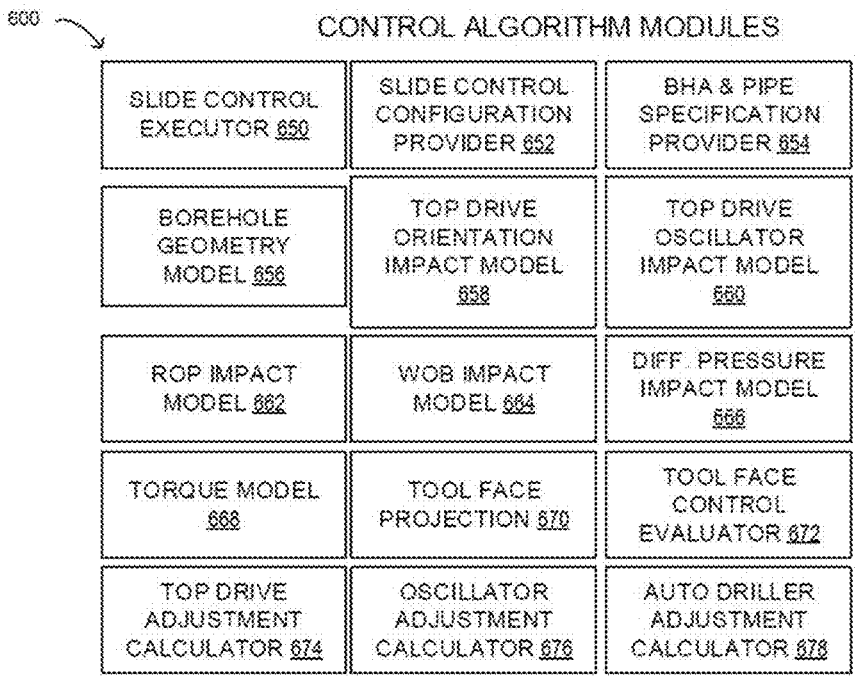
FIG. 6 is a depiction of algorithm modules used by the rig control systems, in accordance with embodiments of the present disclosure.

FIG. 6 illustrates one embodiment of control algorithm modules 600 used with steering control system 168. The control algorithm modules 600 of FIG. 6 include: a slide control executor 650 that is responsible for managing the execution of the slide control algorithms; a slide control configuration provider 652 that is responsible for validating, maintaining, and providing configuration parameters for the other software modules; a BHA & pipe specification provider 654 that is responsible for managing and providing details of BHA 149 and drill string 146 characteristics; a borehole geometry model 656 that is responsible for keeping track of the borehole geometry and providing a representation to other software modules; a top drive orientation impact model 658 that is responsible for modeling the impact that changes to the angular orientation of top drive 140 have had on the toolface control; a top drive oscillator impact model 660 that is responsible for modeling the impact that oscillations of top drive 140 has had on the toolface control; an ROP impact model 662 that is responsible for modeling the effect on the toolface control of a change in ROP or a corresponding ROP set point; a WOB impact model 664 that is responsible for modeling the effect on the toolface control of a change in WOB or a corresponding WOB set point; a differential pressure impact model 666 that is responsible for modeling the effect on the toolface control of a change in differential pressure (DP) or a corresponding DP set point; a torque model 668 that is responsible for modeling the comprehensive representation of torque for surface, downhole, break over, and reactive torque, modeling impact of those torque values on toolface control, and determining torque operational thresholds; a toolface control evaluator 672 that is responsible for evaluating all factors impacting toolface control and whether adjustments need to be projected, determining whether realignment off-bottom is indicated, and determining off-bottom toolface operational threshold windows; a toolface projection 670 that is responsible for projecting toolface behavior for top drive 140, the top drive oscillator, and auto driller adjustments; a top drive adjustment calculator 674 that is responsible for calculating top drive adjustments resultant to toolface projections; an oscillator adjustment calculator 676 that is responsible for calculating oscillator adjustments resultant to toolface projections; and an autodriller adjustment calculator 678 that is responsible for calculating adjustments to autodriller 510 resultant to toolface projections.

Figure 7:
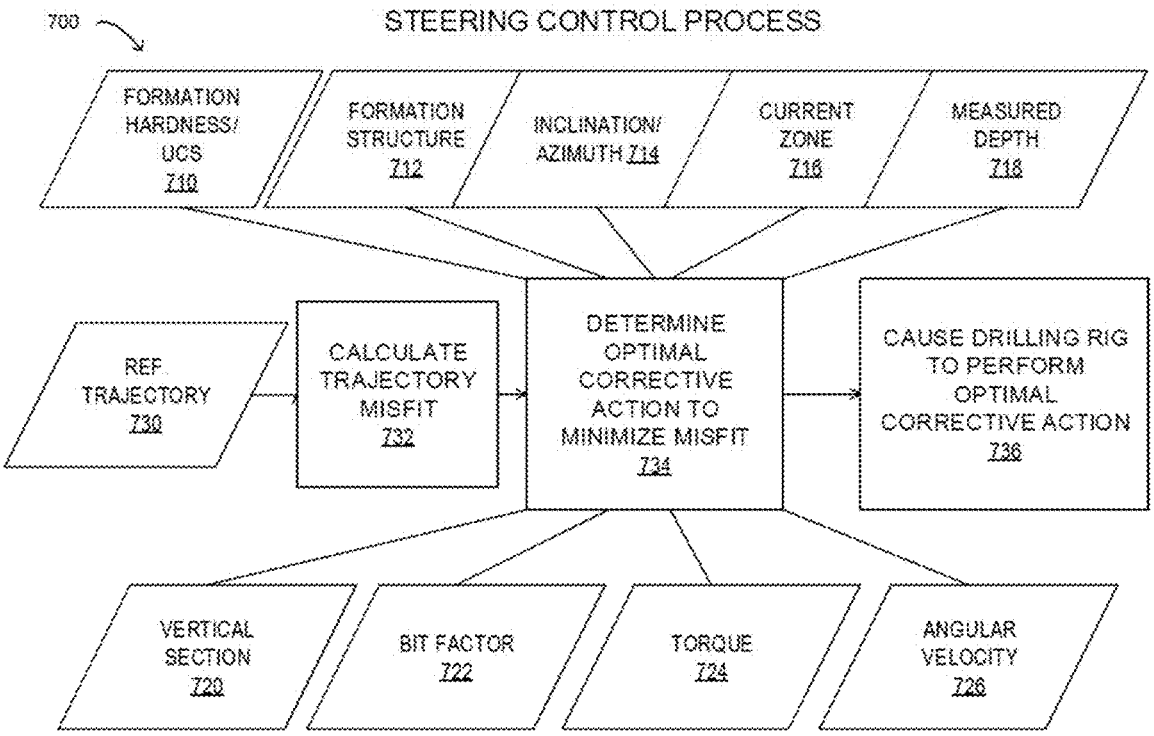
FIG. 7 is a depiction of a steering control process used by the rig control systems, in accordance with embodiments of the present disclosure.

FIG. 7 illustrates one embodiment of a steering control process 700 for determining an optimal corrective action for drilling. Steering control process 700 may be used for rotary drilling or slide drilling in different embodiments.

Steering control process 700 in FIG. 7 illustrates a variety of inputs that may be used to determine an optimum corrective action. As shown in FIG. 7, the inputs include formation hardness/unconfined compressive strength (UCS) 710, formation structure 712, inclination/azimuth 714, current zone 716, measured depth 718, vertical section 720, bit factor 722, mud motor torque 724, reference trajectory 730, and angular velocity 726. In FIG. 7, reference trajectory 730 of borehole 106 is determined to calculate a trajectory misfit in a step 732. Step 732 may output the trajectory misfit to determine an optimal corrective action to minimize the misfit at step 734, which may be performed using the other inputs described above. Then, at step 736, the drilling rig is caused to perform the optimal corrective action.

It is noted that in some implementations, at least certain portions of steering control process 700 may be automated or performed without user intervention. In other implementations, the optimal corrective action in step 736 may be provided or communicated (by display, SMS message, email, or otherwise) to one or more human operators, who may then take appropriate action. The human operators may be members of a rig crew, which may be located at or near drilling rig 210 or may be located remotely from drilling rig 210.

Figure 8:
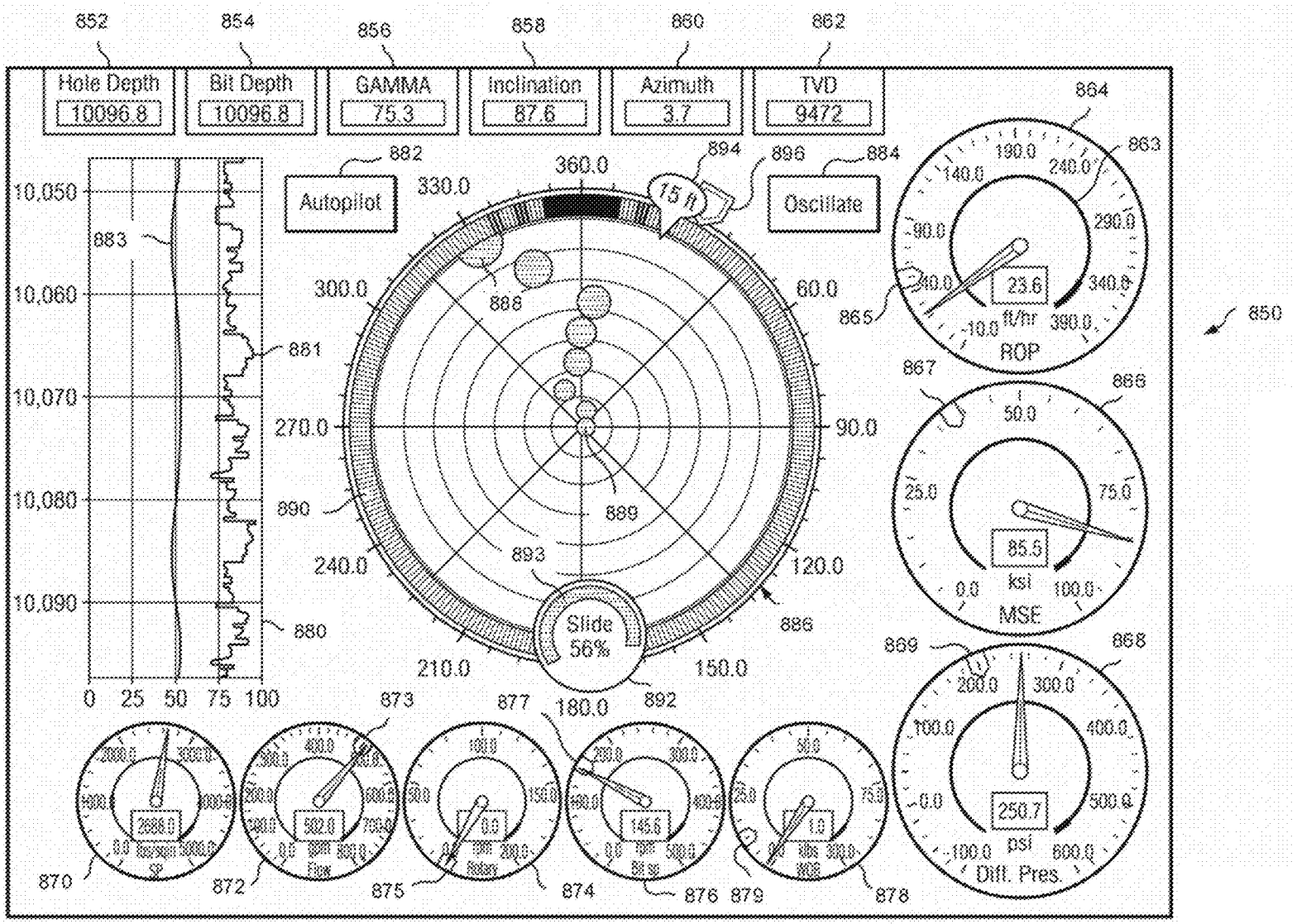
FIG. 8 is a depiction of a graphical user interface provided by the rig control systems, in accordance with embodiments of the present disclosure.

Referring to FIG. 8, one embodiment of a user interface 850 that may be generated by steering control system 168 for monitoring and operation by a human operator is illustrated. User interface 850 may provide many different types of information in an easily accessible format. For example, user interface 850 may be shown on a computer monitor, a television, a viewing screen (e.g., a display device) associated with steering control system 168. In some embodiments, at least certain portions of user interface 850 may be displayed to and operated by a user of steering control system 168 on a mobile device, such as a tablet or a smartphone (see also FIG. 10). For example, steering control system 168 may support mobile applications that enable user interface 850, or other user interfaces, to be used on the mobile device, for example, within a vicinity of drilling rig 210.

As shown in FIG. 8, a user interface 850 provides visual indicators such as a hole depth indicator 852, a bit depth indicator 854, a GAMMA indicator 856, an inclination indicator 858, an azimuth indicator 860, and a TVD indicator 862. Other indicators may also be provided, including a ROP indicator 864, a mechanical specific energy (MSE) indicator 866, a differential pressure indicator 868, a standpipe pressure indicator 870, a flow rate indicator 872, a rotary RPM (angular velocity) indicator 874, a bit speed indicator 876, and a WOB indicator 878.

In FIG. 8, at least some of indicators 864, 866, 868, 870, 872, 874, 876, and 878 may include a marker representing a target value. For example, markers may be set as certain given values, but it is noted that any desired target value may be used. Although not shown, in some embodiments, multiple markers may be present on a single indicator. The markers may vary in color or size. For example, ROP indicator 864 may include a marker 865 indicating that the target value is 50 feet/hour (or 15 miles/hour). MSE indicator 866 may include a marker 867 indicating that the target value is 37 kilograms per square inch (ksi) (or 255 MPa). Differential pressure indicator 868 may include a marker 869 indicating that the target value is 200 pounds per square inch (psi) (or 1,380 kilo Pascal (kPa)). ROP indicator 864 may include a marker 865 indicating that the target value is 50 feet/hour (or 15 miles/hour). Standpipe pressure indicator 870 may have no marker in the present example. Flow rate indicator 872 may include a marker 873 indicating that the target value is 500 gallons per minute (gpm) (or 31.5 liters per second (L/s)). Rotary RPM indicator 874 may include a marker 875 indicating that the target value is 0 RPM (e.g., due to sliding). Bit speed indicator 876 may include a marker 877 indicating that the target value is 150 RPM. WOB indicator 878 may include a marker 879 indicating that the target value is 10 klbs (or 4,500 kg). Each indicator may also include a colored band, or another marking, to indicate, for example, whether the respective gauge value is within a safe range (e.g., indicated by a green color), within a caution range (e.g., indicated by a yellow color), or within a danger range (e.g., indicated by a red color).

In FIG. 8, a log chart 880 may visually indicate depth versus one or more measurements (e.g., may represent log inputs relative to a progressing depth chart). For example, log chart 880 may have a Y-axis representing depth and an X-axis representing a measurement such as GAMMA count 881 (as shown), ROP 883 (e.g., empirical ROP and normalized ROP), or resistivity. An autopilot button 882 and an oscillate button 884 may be used to control activity. For example, autopilot button 882 may be used to engage or disengage autodriller 510, while oscillate button 884 may be used to directly control oscillation of drill string 146 or to engage/disengage an external hardware device or controller.

In FIG. 8, a circular chart 886 may provide current and historical toolface orientation information (e.g., which way the bend is pointed). For purposes of illustration, circular chart 886 represents three hundred and sixty degrees. A series of circles within circular chart 886 may represent a timeline of toolface orientations, with the sizes of the circles indicating the temporal position of each circle. For example, larger circles may be more recent than smaller circles, so a largest circle 888 may be the newest reading and a smallest circle 889 may be the oldest reading. In other embodiments, circles 889, 888 may represent the energy or progress made via size, color, shape, a number within a circle, etc. For example, a size of a particular circle may represent an accumulation of orientation and progress for the period of time represented by the circle. In other embodiments, concentric circles representing time (e.g., with the outside of circular chart 886 being the most recent time and the center point being the oldest time) may be used to indicate the energy or progress (e.g., via color or patterning such as dashes or dots rather than a solid line).

In user interface 850, circular chart 886 may also be color coded, with the color coding existing in a band 890 around circular chart 886 or positioned or represented in other ways. The color coding may use colors to indicate activity in a certain direction. For example, the color red may indicate the highest level of activity, while the color blue may indicate the lowest level of activity. Furthermore, the arc range in degrees of a color may indicate the amount of deviation. Accordingly, a relatively narrow (e.g., thirty degrees) arc of red with a relatively broad (e.g., three hundred degrees) arc of blue may indicate that most activity is occurring in a particular toolface orientation with little deviation. As shown in user interface 850, the color blue may extend from approximately 22-337 degrees, the color green may extend from approximately 15-22 degrees and 337-345 degrees, the color yellow may extend a few degrees around the 13- and 345-degree marks, while the color red may extend from approximately 347-10 degrees. Transition colors or shades may be used with, for example, the color orange marking the transition between red and yellow or a light blue marking the transition between blue and green. This color coding may enable user interface 850 to provide an intuitive summary of how narrow the standard deviation is and how much of the energy intensity is being expended in the proper direction. Furthermore, the center of energy may be viewed relative to the target. For example, user interface 850 may clearly show that the target is at 90 degrees, but the center of energy is at 45 degrees.

In user interface 850, other indicators, such as a slide indicator 892, may indicate how much time remains until a slide occurs or how much time remains for a current slide. For example, slide indicator 892 may represent a time, a percentage (e.g., as shown, a current slide may be 56% complete), a distance completed, or a distance remaining. Slide indicator 892 may graphically display information using, for example, a colored bar 893 that increases or decreases with slide progress. In some embodiments, slide indicator 892 may be built into circular chart 886 (e.g., around the outer edge with an increasing/decreasing band), while in other embodiments, slide indicator 892 may be a separate indicator such as a meter, a bar, a gauge, or another indicator type. In various implementations, slide indicator 892 may be refreshed by autoslide 514.

In user interface 850, an error indicator 894 may indicate a magnitude and a direction of error. For example, error indicator 894 may indicate that an estimated drill bit position is a certain distance from the planned trajectory, with a location of error indicator 894 around the circular chart 886 representing the heading. For example, FIG. 8 illustrates an error magnitude of 15 feet and an error direction of 15 degrees. Error indicator 894 may be any color but may be red for purposes of example. It is noted that error indicator 894 may present a zero if there is no error. Error indicator may represent that drill bit 148 is on the planned trajectory using other means, such as being a green color. Transition colors, such as yellow, may be used to indicate varying amounts of error. In some embodiments, error indicator 894 may not appear unless there is an error in magnitude or direction. A marker 896 may indicate an ideal slide direction. Although not shown, other indicators may be present, such as a bit life indicator to indicate an estimated lifetime for the current bit based on a value such as time or distance.

It is noted that user interface 850 may be arranged in many different ways. For example, colors may be used to indicate normal operation, warnings, and problems. In such cases, the numerical indicators may display numbers in one color (e.g., green) for normal operation, may use another color (e.g., yellow) for warnings, and may use yet another color (e.g., red) when a serious problem occurs. The indicators may also flash or otherwise indicate an alert. The gauge indicators may include colors (e.g., green, yellow, and red) to indicate operational conditions and may also indicate the target value (e.g., an ROP of 100 feet/hour). For example, ROP indicator 864 may have a green bar to indicate a normal level of operation (e.g., from 10-300 feet/hour), a yellow bar to indicate a warning level of operation (e.g., from 300-360 feet/hour), and a red bar to indicate a dangerous or otherwise out of parameter level of operation (e.g., from 360-390 feet/hour). ROP indicator 864 may also display a marker at 100 feet/hour to indicate the desired target ROP.

Furthermore, the use of numeric indicators, gauges, and similar visual display indicators may be varied based on factors such as the information to be conveyed and the personal preference of the viewer. Accordingly, user interface 850 may provide a customizable view of various drilling processes and information for a particular individual involved in the drilling process. For example, steering control system 168 may enable a user to customize the user interface 850 as desired, although certain features (e.g., standpipe pressure) may be locked to prevent a user from intentionally or accidentally removing important drilling information from user interface 850. Other features and attributes of user interface 850 may be set by user preference. Accordingly, the level of customization and the information shown by the user interface 850 may be controlled based on who is viewing user interface 850 and their role in the drilling process.

Figure 9:
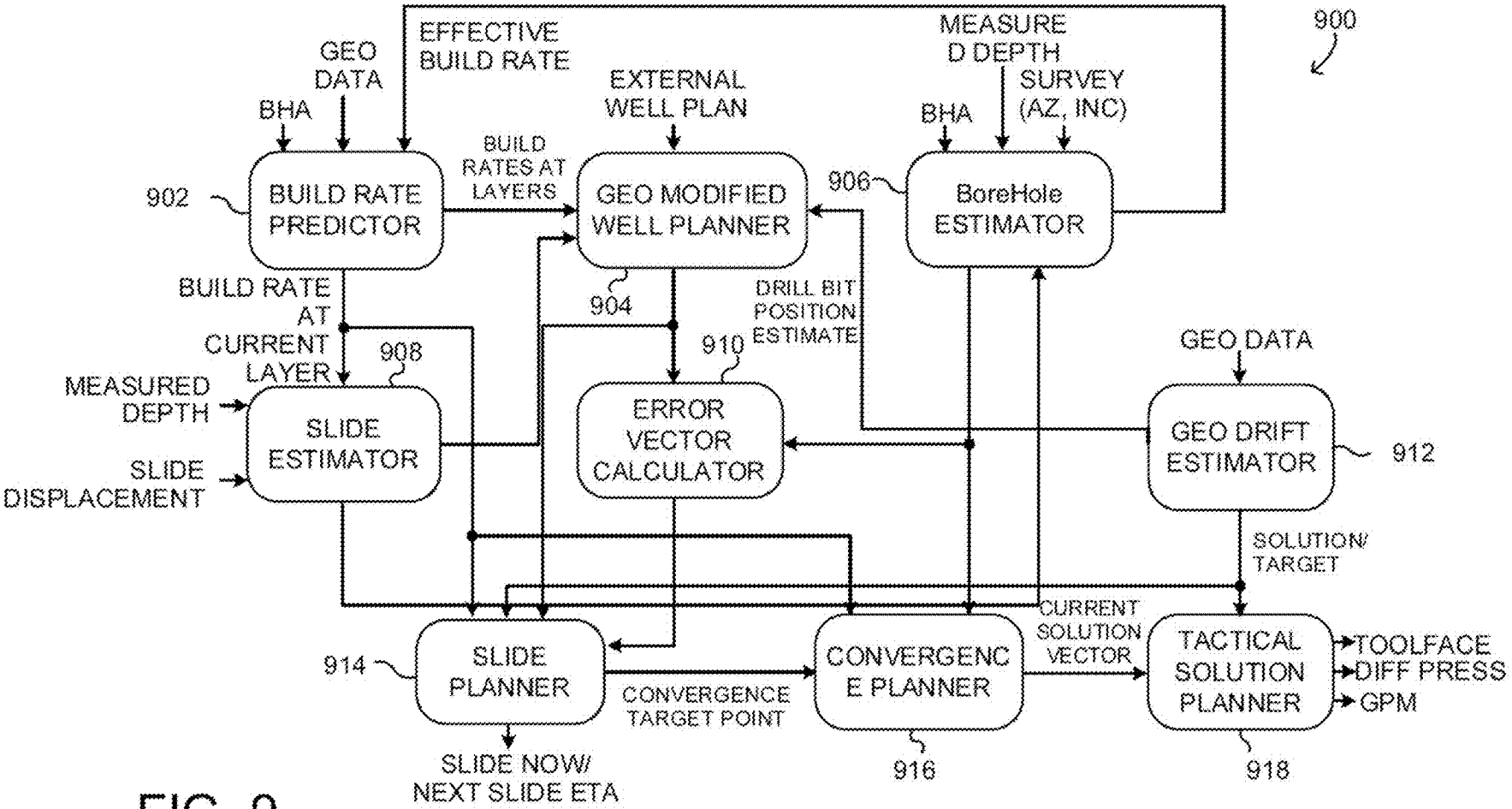
FIG. 9 is a depiction of a guidance control loop performed by the rig control systems, in accordance with embodiments of the present disclosure.

Referring to FIG. 9, one embodiment of a guidance control loop (GCL) 900 is shown in further detail GCL 900 may represent one example of a control loop or control algorithm executed under the control of steering control system 168. GCL 900 may include various functional modules, including a build rate predictor 902, a geo modified well planner 904, a borehole estimator 906, a slide estimator 908, an error vector calculator 910, a geological drift estimator 912, a slide planner 914, a convergence planner 916, and a tactical solution planner 918. In the following description of GCL 900, the term "external input" refers to input received from outside GCL 900, while "internal input" refers to input exchanged between functional modules of GCL 900.

In FIG. 9, build rate predictor 902 receives external input representing BHA information and geological information, receives internal input from the borehole estimator 906, and provides output to geo modified well planner 904, slide estimator 908, slide planner 914, and convergence planner 916. Build rate predictor 902 is configured to use the BHA information and geological information to predict drilling build rates of current and future sections of borehole 106. For example, build rate predictor 902 may determine how aggressively a curve may be built for a given formation with BHA 149 and other equipment parameters.

In FIG. 9, build rate predictor 902 may use the orientation of BHA 149 to the formation to determine an angle of attack for formation transitions and build rates within a single layer of a formation. For example, if a strata layer of rock is below a strata layer of sand, a formation transition exists between the strata layer of sand and the strata layer of rock. Approaching the strata layer of rock at a 90-degree angle may provide a good toolface and a clean drill entry, while approaching the rock layer at a 45-degree angle may build a curve relatively quickly. An angle of approach that is near parallel may cause drill bit 148 to skip off the upper surface of the strata layer of rock. Accordingly, build rate predictor 902 may calculate BHA orientation to account for formation transitions. Within a single strata layer, build rate predictor 902 may use the BHA orientation to account for internal layer characteristics (e.g., grain) to determine build rates for various parts of a strata layer. The BHA information may include bit characteristics, mud motor bend setting, stabilization, and mud motor bit to bend distance. The geological information may include formation data such as compressive strength, thicknesses, and depths for formations encountered in the specific drilling location. Such information may enable a calculation-based prediction of the build rates and ROP that may be compared to both results obtained while drilling borehole 106 and regional historical results (e.g., from the regional drilling DB 412) to improve the accuracy of predictions as drilling progresses. Build rate predictor 902 may also be used to plan convergence adjustments and confirm in advance of drilling that targets may be achieved with current parameters.

In FIG. 9, geo modified well planner 904 receives external input representing a drill plan, internal input from build rate predictor 902 and geological drift estimator 912 and provides output to slide planner 914 and error vector calculator 910. Geo modified well planner 904 uses the input to determine whether there is a more optimal trajectory than that provided by the drill plan, while staying within specified error limits. More specifically, geo modified well planner 904 takes geological information (e.g., drift) and calculates whether another trajectory solution to the target may be more efficient in terms of cost or reliability. The outputs of geo modified well planner 904 to slide planner 914 and error vector calculator 910 may be used to calculate an error vector based on the current vector to the newly calculated trajectory and to modify slide predictions. In some embodiments, geo modified well planner 904 (or another module) may provide functionality needed to track a formation trend. For example, in horizontal wells, a geologist may provide steering control system 168 with a target inclination as a set point for steering control system 168 to control. For example, the geologist may enter a target to steering control system 168 of 90.5-91.0 degrees of inclination for a section of borehole 106. Geo modified well planner 904 may then treat the target as a vector target, while remaining within the error limits of the original drill plan. In some embodiments, geo modified well planner 904 may be an optional module that is not used unless the drill plan is to be modified. For example, if the drill plan is marked in steering control system 168 as non-modifiable, geo modified well planner 904 may be bypassed altogether or geo modified well planner 904 may be configured to pass the drill plan through without any changes.

In FIG. 9, borehole estimator 906 may receive external inputs representing BHA information, measured depth information, survey information (e.g., azimuth and inclination), and may provide outputs to build rate predictor 902, error vector calculator 910, and convergence planner 916. Borehole estimator 906 may be configured to provide an estimate of the actual borehole and drill bit position and trajectory angle without delay, based on either straight-line projections or projections that incorporate sliding. Borehole estimator 906 may be used to compensate for a sensor being physically located some distance behind drill bit 148 (e.g., 50 feet) in drill string 146, which makes sensor readings lag the actual bit location by 50 feet. Borehole estimator 906 may also be used to compensate for sensor measurements that may not be continuous (e.g., a sensor measurement may occur every 100 feet). Borehole estimator 906 may provide the most accurate estimate from the surface to the last survey location based on the collection of survey measurements. Also, borehole estimator 906 may take the slide estimate from slide estimator 908 (described below) and extend the slide estimate from the last survey point to a current location of drill bit 148. Using the combination of these two estimates, borehole estimator 906 may provide steering control system 168 with an estimate of the drill bit's location and trajectory angle from which guidance and steering solutions may be derived. An additional metric that may be derived from the borehole estimate is the effective build rate that is achieved throughout the drilling process.

In FIG. 9, slide estimator 908 receives external inputs representing measured depth and differential pressure information, receives internal input from build rate predictor 902, and provides output to borehole estimator 906 and geo modified well planner 904. Slide estimator 908 may be configured to sample toolface orientation, differential pressure, measured depth (MD) incremental movement, MSE, and other sensor feedback to quantify/estimate a deviation vector and progress while sliding.

Traditionally, deviation from the slide would be predicted by a human operator based on experience. The operator would, for example, use a long slide cycle to assess what likely was accomplished during the last slide. However, the results are generally not confirmed until the downhole survey sensor point passes the slide portion of the borehole, often resulting in a response lag defined by a distance of the sensor point from the drill bit tip (e.g., approximately 50 feet). Such a response lag may introduce inefficiencies in the slide cycles due to over/under correction of the actual trajectory relative to the planned trajectory.

In GCL 900, using slide estimator 908, each toolface update may be algorithmically merged with the average differential pressure of the period between the previous and current toolface readings, as well as the MD change during this period to predict the direction, angular deviation, and MD progress during the period. As an example, the periodic rate may be between 10 and 60 seconds per cycle depending on the toolface update rate of downhole tool 166. With a more accurate estimation of the slide effectiveness, the sliding efficiency may be improved. The output of slide estimator 908 may accordingly be periodically provided to borehole estimator 906 for accumulation of well deviation information, as well to geo modified well planner 904. Some or all of the output of the slide estimator 908 may be output to an operator, such as shown in the user interface 850 of FIG. 8.

In FIG. 9, error vector calculator 910 may receive internal input from geo modified well planner 904 and borehole estimator 906. Error vector calculator 910 may be configured to compare the planned well trajectory to an actual borehole trajectory and drill bit position estimate. Error vector calculator 910 may provide the metrics used to determine the error (e.g., how far off) the current drill bit position and trajectory are from the drill plan. For example, error vector calculator 910 may calculate the error between the current bit position and trajectory to the planned trajectory and the desired bit position. Error vector calculator 910 may also calculate a projected bit position/projected trajectory representing the future result of a current error.

In FIG. 9, geological drift estimator 912 receives external input representing geological information and provides outputs to geo modified well planner 904, slide planner 914, and tactical solution planner 918. During drilling, drift may occur as the particular characteristics of the formation affect the drilling direction. More specifically, there may be a trajectory bias that is contributed by the formation as a function of ROP and BHA 149. Geological drift estimator 912 is configured to provide a drift estimate as a vector that may then be used to calculate drift compensation parameters that may be used to offset the drift in a control solution.

In FIG. 9, slide planner 914 receives internal input from build rate predictor 902, geo modified well planner 904, error vector calculator 910, and geological drift estimator 912, and provides output to convergence planner 916 as well as an estimated time to the next slide. Slide planner 914 may be configured to evaluate a slide/drill ahead cost equation and plan for sliding activity, which may include factoring in BHA wear, expected build rates of current and expected formations, and the drill plan trajectory. During drill ahead, slide planner 914 may attempt to forecast an estimated time of the next slide to aid with planning. For example, if additional lubricants (e.g., fluorinated beads) are indicated for the next slide, and pumping the lubricants into drill string 146 has a lead time of 30 minutes before the slide, the estimated time of the next slide may be calculated and then used to schedule when to start pumping the lubricants. Functionality for a loss circulation material (LCM) planner may be provided as part of slide planner 914 or elsewhere (e.g., as a stand-alone module or as part of another module described herein). The LCM planner functionality may be configured to determine whether additives should be pumped into the borehole based on indications such as flow-in versus flow-back measurements. For example, if drilling through a porous rock formation, fluid being pumped into the borehole may get lost in the rock formation. To address this issue, the LCM planner may control pumping LCM into the borehole to clog up the holes in the porous rock surrounding the borehole to establish a more closed-loop control system for the fluid.

In FIG. 9, slide planner 914 may also look at the current position relative to the next connection. A passageway may happen every 90 to 100 feet (or some other distance or distance range based on the particulars of the drilling operation) and slide planner 914 may avoid planning a slide when close to a passageway or when the slide would carry through the connection. For example, if the slide planner 914 is planning a 50-foot slide but only 20 feet remain until the next connection, slide planner 914 may calculate the slide starting after the next passageway and make any changes to the slide parameters to accommodate waiting to slide until after the next connection. Such flexible implementation avoids inefficiencies that may be caused by starting the slide, stopping for the connection, and then having to reorient the toolface before finishing the slide. During slides, slide planner 914 may provide some feedback as to the progress of achieving the desired goal of the current slide. In some embodiments, slide planner 914 may account for reactive torque in the drill string 146. More specifically, when rotating is occurring, there is a reactional torque wind up in drill string 146. When the rotating is stopped, drill string 146 unwinds, which changes toolface orientation and other parameters. When rotating is started again, drill string 146 starts to wind back up. Slide planner 914 may account for the reactional torque so that toolface references are maintained, rather than stopping rotation and then trying to adjust to an optimal toolface orientation. While not all downhole tools may provide toolface orientation when rotating, using one that does supply such information for GCL 900 may significantly reduce the transition time from rotating to sliding.

In FIG. 9, convergence planner 916 receives internal inputs from build rate predictor 902, borehole estimator 906, and slide planner 914, and provides output to tactical solution planner 918. Convergence planner 916 is configured to provide a convergence plan when the current drill bit position is not within a defined margin of error of the planned well trajectory. The convergence plan represents a path from the current drill bit position to an achievable and optimal convergence target point along the planned trajectory. The convergence plan may take account the amount of sliding/drilling ahead that has been planned to take place by slide planner 914. Convergence planner 916 may also use BHA orientation information for angle of attack calculations when determining convergence plans as described above with respect to build rate predictor 902. The solution provided by convergence planner 916 defines a new trajectory solution for the current position of drill bit 148. The solution may be immediate without delay or planned for implementation at a future time that is specified in advance.

In FIG. 9, tactical solution planner 918 receives internal inputs from geological drift estimator 912 and convergence planner 916 and provides external outputs representing information such as toolface orientation, differential pressure, and mud flow rate. Tactical solution planner 918 is configured to take the trajectory solution provided by convergence planner 916 and translate the solution into control parameters that may be used to control drilling rig 210. For example, tactical solution planner 918 may convert the solution into settings for control systems 522, 524, and 526 to accomplish the actual drilling based on the solution. Tactical solution planner 918 may also perform performance optimization to optimizing the overall drilling operation as well as optimizing the drilling itself (e.g., how to drill faster).

Other functionality may be provided by GCL 900 in additional modules or added to an existing module. For example, there is a relationship between the rotational position of the drill pipe on the surface and the orientation of the downhole toolface. Accordingly, GCL 900 may receive information corresponding to the rotational position of the drill pipe on the surface. GCL 900 may use this surface positional information to calculate current and desired toolface orientations. These calculations may then be used to define control parameters for adjusting the top drive 140 to accomplish adjustments to the downhole toolface in order to steer the trajectory of borehole 106.

For purposes of example, an object-oriented software approach may be utilized to provide a class-based structure that may be used with GCL 900, or other functionality provided by steering control system 168. In GCL 900, a drilling model class may be defined to capture and define the drilling state throughout the drilling process. The drilling model class may include information obtained without delay. The drilling model class may be based on the following components and sub-models: a drill bit model, a borehole model, a rig surface gear model, a mud pump model, a/differential pressure model, a positional/rotary model, an MSE model, an active drill plan, and control limits. The drilling model class may produce a control output solution and may be executed via a main processing loop that rotates through the various modules of GCL 900. The drill bit model may represent the current position and state of drill bit 148. The drill bit model may include a three-dimensional (3D) position, a drill bit trajectory, BHA information, bit speed, and toolface (e.g., orientation information). The 3D position may be specified in north-south (NS), east-west (EW), and true vertical depth (TVD). The drill bit trajectory may be specified as an inclination angle and an azimuth angle. The BHA information may be a set of dimensions defining the active BHA. The borehole model may represent the current path and size of the active borehole. The borehole model may include hole depth information, an array of survey points collected along the borehole path, a gamma log, and borehole diameters. The hole depth information is for current drilling of borehole 106. The borehole diameters may represent the diameters of borehole 106 as drilled over current drilling. The rig surface gear model may represent pipe length, block height, and other models, such as the mud pump model, WOB/differential pressure model, positional/rotary model, and MSE model. The mud pump model represents mud pump equipment and includes flow rate, standpipe pressure, and differential pressure. The WOB/differential pressure model represents draw works or other WOB/differential pressure controls and parameters, including WOB. The positional/rotary model represents top drive or other positional/rotary controls and parameters including rotary RPM and spindle position. The active drill plan represents the target borehole path and may include an external drill plan and a modified drill plan. The control limits represent defined parameters that may be set as maximums and/or minimums. For example, control limits may be set for the rotary RPM in the top drive model to limit the maximum RPMs to the defined level. The control output solution may represent the control parameters for drilling rig 210.

Each functional module of GCL 900 may have behavior encapsulated within a respective class definition. During a processing window, the individual functional modules may have an exclusive portion in time to execute and update the drilling model. For purposes of example, the processing order for the functional modules may be in the sequence of geo modified well planner 904, build rate predictor 902, slide estimator 908, borehole estimator 906, error vector calculator 910, slide planner 914, convergence planner 916, geological drift estimator 912, and tactical solution planner 918. It is noted that other sequences may be used in different implementations.

In FIG. 9, GCL 900 may rely on a programmable timer module that provides a timing mechanism to provide timer event signals to drive the main processing loop. While steering control system 168 may rely on timer and date calls driven by the programming environment, timing may be obtained from other sources than system time. In situations where it may be advantageous to manipulate the clock (e.g., for evaluation and testing), a programmable timer module may be used to alter the system time. For example, the programmable timer module may enable a default time set to the system time and a time scale of 1.0, may enable the system time of steering control system 168 to be manually set, may enable the time scale relative to the system time to be modified, or may enable periodic event time requests scaled to a requested time scale.

Referring now to FIG. 10, a block diagram illustrating selected elements of an embodiment of a controller 1000 for performing steering methods and systems for improved drilling performance according to the present disclosure. In various embodiments, controller 1000 may represent an implementation of steering control system 168.

In the embodiment depicted in FIG. 10, controller 1000 includes processor 1001 coupled via shared bus 1002 to storage media collectively identified as memory media 1010.

Controller 1000, as depicted in FIG. 10, further includes network adapter 1020 that interfaces controller 1000 to a network (not shown in FIG. 10). In embodiments suitable for use with user interfaces, controller 1000, as depicted in FIG. 10, may include peripheral adapter 1006, which provides connectivity for the use of input device 1008 and output device 1009. Input device 1008 may represent a device for user input, such as a keyboard or a mouse, or even a video camera. Output device 1009 may represent a device for providing signals or indications to a user, such as loudspeakers for generating audio signals.

Controller 1000 is shown in FIG. 10 including display adapter 1004 and further includes a display device 1005. Display adapter 1004 may interface shared bus 1002, or another bus, with an output port for one or more display devices, such as display device 1005. Display device 1005 may be implemented as a liquid crystal display screen, a computer monitor, a television, or the like. Display device 1005 may comply with a display standard for the corresponding type of display. Standards for computer monitors include analog standards such as video graphics array (VGA), extended graphics array (XGA), etc., or digital standards such as digital visual interface (DVI), definition multimedia interface (HDMI), among others. A television display may comply with standards such as NTSC (National Television System Committee), PAL (Phase Alternating Line), or another suitable standard. Display device 1005 may include an output device 1009, such as one or more integrated speakers to play audio content, or may include an input device 1008, such as a microphone or video camera.

In FIG. 10, memory media 1010 encompasses persistent and volatile media, fixed and removable media, and magnetic and semiconductor media. Memory media 1010 is operable to store instructions, data, or both. Memory media 1010 as shown includes sets or sequences of instructions 1024-2, namely, an operating system 1012 and steering control 1014. Operating system 1012 may be a UNIX or UNIX-like operating system, a Windows® family operating system, or another suitable operating system. Instructions 1024 may also reside, completely or at least partially, within processor 1001 during execution thereof. It is further noted that processor 1001 may be configured to receive instructions 1024-1 from instructions 1024-2 via shared bus 1002. In some embodiments, memory media 1010 is configured to store and provide executable instructions for executing GCL 900, as mentioned previously, among other methods and operations disclosed herein.

As noted previously, steering control system 168 may support the display and operation of various user interfaces, such as in a client/server architecture. For example, steering control 1014 may be enabled to support a web server for providing the user interface to a web browser client, such as on a mobile device or on a personal computer device. In another example, steering control 1014 may be enabled to support an app server for providing the user interface to a client app, such as on a mobile device or on a personal computer device. It is noted that in the web server or the app server architecture, surface steering control 1014 may handle various communications to rig controls 520 while simultaneously supporting the web browser client or the client app with the user interface.

Unwinding Drill String Torque

Under normal drilling conditions for an oil or gas well, the drill string 146 may extend thousands of feet downhole. In many situations, the drill string 146 under typical conditions may experience many "wraps" of torsional deflection from its position at the surface to its position at the drill bit. There are many cases where this torsional deflection must be relieved prior to subsequent operations. Situations in which this torsional deflection must be relieved include: adding a new stand of drill pipe to the drill string 146 to continue drilling; prior to disengaging bottom after a mud-motor stall has been experienced; working out the trapped torque from the drill string 146 in preparation for a slide drilling operation; and after torquing a stand of drill-pipe against the rotary table.

Typically, the drill string 146 torque may be released by rotating the pipe in the opposite direction to the "trapped" torque until the drill string 146 has unwound (e.g., the drill string 146 torque has become close to or equal to zero). There may be significant variations in the number of wraps to be unwound in order to release the torque (energy) stored in the drill string 146.

Automated drilling processes require this "unwind" process to be managed by one or more control systems 168 of the drilling rig. One of the challenges to automating the unwind process is knowing how much drill string 146 deflection is in the amount of the stored drill string 146 torque. Due to the delays between the rig control system 168 and the variable frequency drive (VFD), deciding to unwind until the torque has approached zero may result in overshooting the desired amount of unwinding, especially if the unwind speed selected is higher. Unwinding slowly may avoid the overshoot problem but is inefficient when many wraps must be released and the unwind process takes an extended amount of time. For example, unwinding after making a connection of a stand to the drill string 146 may require (typically) 0.25 wraps to relive the torque versus a required 8+ wraps when unwinding a drill string 146 that has 20,000 ft of drill-pipe.

Figure 11B:
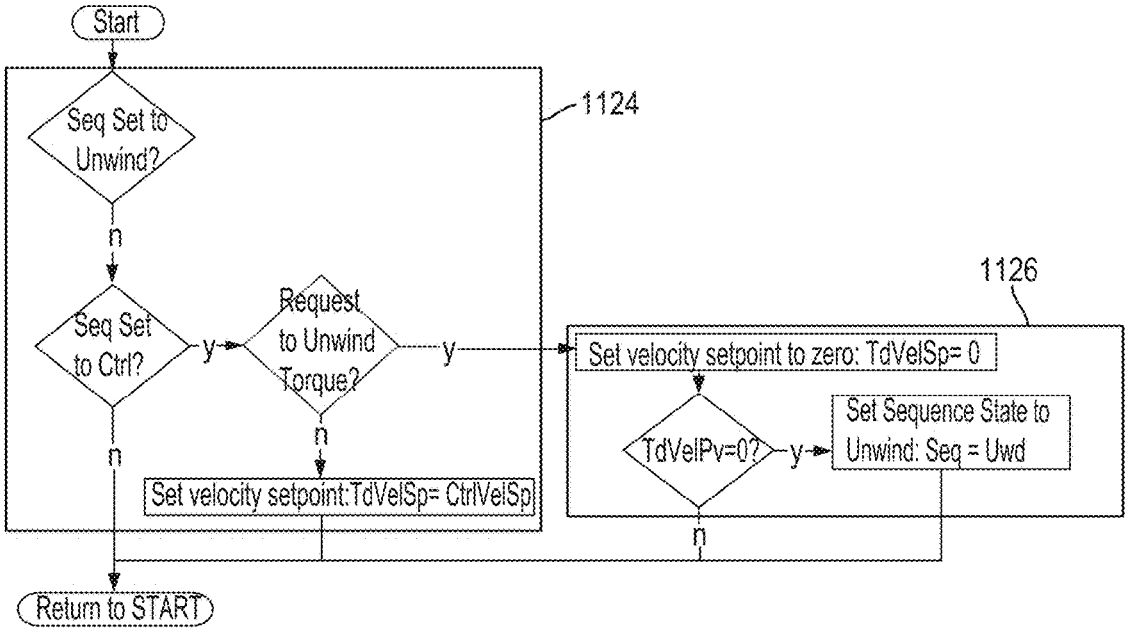

Referring now to FIGS. 11A and 11B, a non-limiting exemplary method for unwinding the torque in a drill string 146 is shown as a flow chart. While the method 1100 herein is described as being performed via the control system 168, the method 1100 may also be implemented using one or more separate control systems. Operations and methods herein may be optional, rearranged, or used in tandem with additional implementations, such as implementing the torque unwind method and system in conjunction with stall detection and assist as described in U.S. Pat. No. 11,466,556 B2 issued on Oct. 11, 2022, entitled "STALL DETECTION AND RECOVERY FOR MUD MOTORS," the entire contents of which is hereby incorporated by reference in its entirety for all purposes.

As described below, method 1100 is explained based on implementation of torque detection and unwind control according to embodiments of the present disclosure. In some embodiments, the steps depicted in FIGS. 11A and 11B maybe executed by software running on the one or more PLCs of the drilling rig control system 168. The PLCs of the drilling rig control system 168 may further be connected via a serial communication method to the VFD. In some embodiments, the VFD may be utilized to calculate the motor torque based on measured current. For example, the VFD may calculate the motor torque based on measured current using the current transformers contained within the VFD, the voltage level generated by the VFD and being applied to the motor, and the frequency of the voltage waveform generated by the VFD and applied to the motor and measured shaft speed from an incremental encoder mounted on the saft and electrically connected to the VFD.

In some embodiments, the method 1100 may be manually initiated by a user during operations. For example, a torque unwind option may be included in a GUI, which when selected may send a command to initiate method 1100. Additionally, or alternatively, the method 1100 may be automatically initiated based on the drilling operations. For example, when the torque feedback reaches a particular threshold value, a command may be sent to the control system 168 to initiate the torque unwind method 1100. Alternatively or additionally, a control system 168 may be programmed to determine when torque in the drill string 146 needs to be released, such as determining that a slide drilling operation is anticipated or needed, a new stand of drill pipe is to be added to the drill string 146, or any other condition has occurred such that releasing the torque in the drill string 146 is desirable. The method 1100 may begin at step 1102 (FIG. 11A), by receiving an unwind request within the control system 168 to unwind the torque. For example, a user command may trigger the unwinding of the top drive 140 torque by selecting a torque unwind option in a GUI. In some embodiments, the top drive 140 sequence state may be in a control state at step 1102. For example, during drilling rig operations, the top drive 140 may be regulated by the control system 168 in a control state. The control state may be associated with a speed control mode in which the speed of the top drive 140 is measured and regulated. The speed control mode may regulate the top drive 140 speed based on various parameters such as a top drive 140 velocity feedback and torque limit. For example, a velocity setpoint may be input to designate the desired velocity of the top drive 140. In some embodiments, when in speed control mode, the top drive 140 may employ a proportional integral (PI) control loop to regulate velocity. As such, the error between setpoint and feedback may be used to generate a torque reference within the VFD. The torque reference may be limited to stay below the torque limit sent by the control system 168.

In some embodiments, when the unwind sequence is initiated, the top drive 140 sequence state may be in a control state. If the unwind request is set to a low state, step 1124 (FIG. 11B) may be initiated, under regular operating conditions. As a result, the VFD may remain in speed control mode, as the VFD is sent a control velocity setpoint. For example, when the unwind request is low and the VFD is in speed control mode, the desired operating velocity may be sent to the VFD. At step 1126, once the unwind request is set to a high state, the top drive 140 velocity setpoint may be set to zero. For example, the top drive 140 may be slowed to a stop by setting the top drive 140 velocity setpoint to zero. Once the shaft has been determined to have stopped, the top drive 140 sequence state may be set to Unwind.

Once the top drive 140 sequence has been set to Unwind and the unwind request remains high, step 1104 (FIG. 11A) may commence and the top drive 140 may transition to torque mode. During drilling rig operations, the top drive 140 may be in speed control mode and prompted to transition to torque mode after initiating the torque unwind method, in turn, a zero torque setpoint may be sent to the VFD. For example, after unwind mode is commenced, the torque reference may be set to zero and a velocity setpoint of the speed control mode may be set to zero. When the velocity setpoint is set to zero, the top drive 140 may be commanded to stop all rotation. For example, during operation of the drilling rig, when torque unwind is selected via a GUI, the top drive 140 may be commanded to cease rotation. Once rotation has stopped, the control system 168 may transition to a torque mode and a torque setpoint is set to zero. While in torque mode, the VFD may regulate the motor torque to reach the torque setpoint or reference while the motor speed is less than the speed limit. If the speed limit is exceeded, the VFD speed limit circuit may become active, proportionally regulating the torque. The unwind direction can then be determined.

At step 1106, a determination of the unwind direction to configure the speed limit control is made. For example, a determination is made on whether to set the speed limit control is in a forward direction or in a reverse direction. The speed limit control may be used to maintain rotational speeds below a specified threshold value. For example, when top drive 140 rotates at high speeds with no load or a minimal load, the speed limit control may be used to prevent rotational speeds from exceeding a threshold value. If the specified threshold limit is exceeded during torque control, a suppressing torque may be applied in the opposite direction of the top drive 140 rotation. For example, if the top drive 140 exceeds a threshold speed limit, then a proportional torque may be applied in the opposite direction until the rotational speed falls below the threshold value. In some embodiments, a speed limit bias may be set to add margins to the speed limit. For example, a speed limit bias of plus or minus a specified value, extending the speed limit bias in both the forward and reverse directions. The speed limit bias may be set as the same value for both the forward and reverse directions and may be applied to the speed limit setpoint and to the zero (e.g., stopped) speed. The speed limit bias may depend on the direction of the speed limit. For example, if 30 RPM is the speed limit and there is a 1% speed limit bias, then, when a forward unwind command is issued, the speed limiting circuit may be active when the velocity is less than equal to 1% and the velocity is more than 30 RPM plus 1%. The speed limit bias may be a VFD setting and may be relative to the maximum operating frequency set within the VFD. For example, if a 1% speed limit bias is equivalent to the speed limit bias being 4 RPM, then the speed limiting in the forward direction may start when the velocity is less than −4 RPM or when the velocity is more than or equal to 30 RPM plus 4 RPM or 34 RPM. Moreover, if the unwind in reverse direction is commanded, then the speed limit circuit may be active when the velocity is less than −30 RPM minus 4 RPM or −34 RPM or when the velocity is more than 4 RPM.

In some embodiments, the sign of the torque feedback value is used to determine the direction to configure the speed limit control. If the torque feedback value is more than or equal to zero, then a command to unwind in a reverse direction is set. For example, if the torque feedback value is more than or equal to zero, then the top drive 140 may rotate the drill string 146 in a reverse direction to relieve the torque. If the torque feedback value is less than zero, then a command to unwind in a forward direction is set. For example, if the torque feedback value is less than zero, then the trapped torque in the drill string 146 may rotate the top drive 140 in a forward direction to relieve the torque.

Based on the configured direction of the speed limit control, the top drive 140 velocity limit to unwind the torque may be set. At step 1108, if the unwind direction is determined to be reverse, the top drive velocity limit is set to a negative threshold value. In some embodiments, if it is determined that the speed limit control is to be rotated in a reverse direction, the top drive 140 velocity limit setpoint may be set to a negative threshold value. For example, once it is determined that the drill string 146 is to be rotated in a reverse direction, a negative setpoint value may be input for the unwind speed limit. At step 1112, if the unwind direction is determined to be forward, the top drive velocity limit is set to a positive threshold value. In some embodiments, if it is determined that the speed limit control is to be rotated in a forward direction, the top drive 140 velocity limit setpoint may be set to a positive threshold value. For example, once it is determined that the drill string 146 is to be rotated in a forward direction, a positive setpoint value may be input for the unwind speed limit.

When the rotational direction to release the torque is determined, the top drive 140 may initiate rotation to release the torque. At step 1110, when unwind direction is reverse, a determination of whether or not torque unwind has been achieved commences. For example, if the torque and speed feedback fall below particular threshold values, the control system 168 raises a flag indicating that the unwind of the drill string 146 has completed. In some embodiments, at least two factors may be checked to determine if torque unwind has been achieved. A factor may be the top drive 140 torque feedback falling below the torque unwind completion threshold value. Additionally, and/or alternatively, a factor may be the absolute value of the velocity feedback speed falling below the unwind speed threshold value. Step 1116 may be initiated in response to the torque feedback value and the velocity feedback value both falling below respective unwind torque threshold and unwind speed threshold values. At step 1116, if the torque and speed of the top drive 140 fall below respective threshold values, the control system 168 may raise a flag indicating that the torque unwind has completed.

At step 1114, if the unwind direction is forward, a determination of whether or not torque unwind has been achieved commences. For example, if the torque and speed feedback fall below or exceed particular threshold values, the control system 168 determines that the unwind of the drill string 146 has completed. In some embodiments at least two factors may be checked to determine if torque unwind has been achieved. A factor may be the top drive 140 torque feedback exceeding the negative torque unwind completion threshold value. Additionally, and/or alternatively, a factor may be the absolute value of the velocity feedback falling below the unwind speed threshold value. Step 1116 may be initiated in response to the torque feedback value and the velocity feedback value both meeting respective unwind torque threshold and unwind speed threshold values. As previously discussed, at step 1116, if the torque and speed of the top drive 140 meet respective threshold values, the control system 168 may raise a flag indicating that the torque unwind has completed.

Once the torque and speed of the top drive 140 reach desired threshold values, step 1118 may commence. At step 1118, the unwind request has dropped to low. In turn, the VFD may be placed in speed control mode and the velocity setpoint may be set to zero in order to stop rotation of the top drive 140. At step 1120, the quill shaft is evaluated to determine if rotation has stopped. In some embodiments, to determine if the quill shaft has stopped, the measured shaft speed is examined. For example, if the top drive 140 quill shaft velocity feedback is approximately zero, the quill shaft may be considered stopped. Once the quill shaft has been determined to be stopped, step 1122 may begin. At step 1122 the top drive 140 sequence state may be set to Control. As a result of setting the sequence state to Control, the logic of steps 1124 and 1126 (FIG. 11B) may be evaluated for controlling the VFD in speed control mode.

In some embodiments, while the system is in the process of unwinding torque in torque mode, the command to unwind may be canceled or removed. For example, after a user has initiated the torque unwind, the user may input a subsequent command to cease the torque unwind process. When a command to cease unwind is received, the top drive 140 may transition from torque mode to speed control mode. In turn the velocity setpoint is set to zero and the VFD is placed into speed control mode. Once the top drive 140 rotation has stopped, the unwind state is exited and regular top drive 140 control may resume for standard operations.

In some embodiments, debounce times may be applied during the torque unwind method to reject noise on the torque and speed feedback signals from false triggering a completed unwind status.

In some embodiments if the torque feedback switches between positive and negative values during the torque unwind process, the control system 168 may be modified to change the torque unwind direction.

Figure 12A:
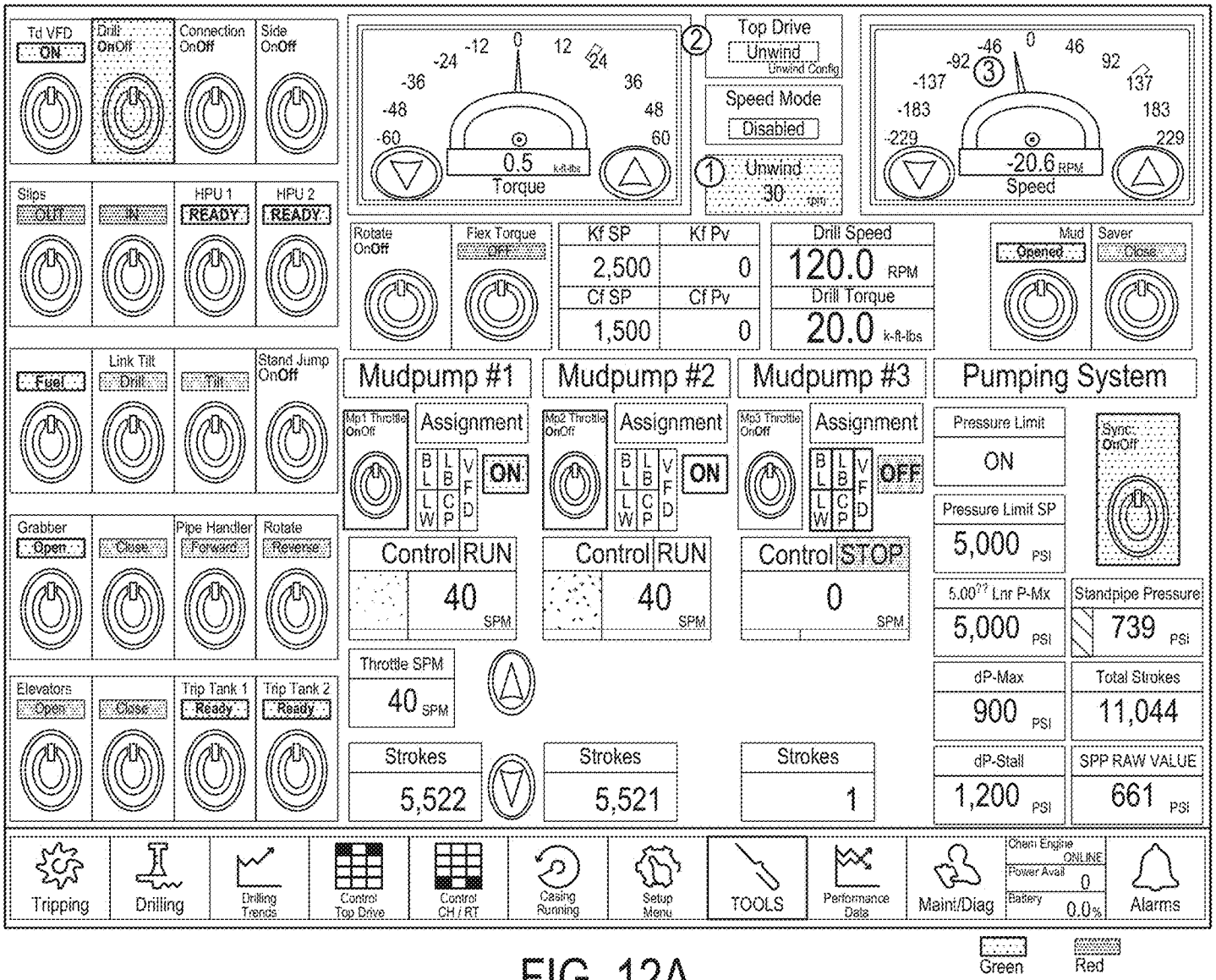
FIGS. 12A and 12B is a depiction of user interfaces for enabling torque unwind, in accordance with embodiments of the present disclosure.
Figure 12B:
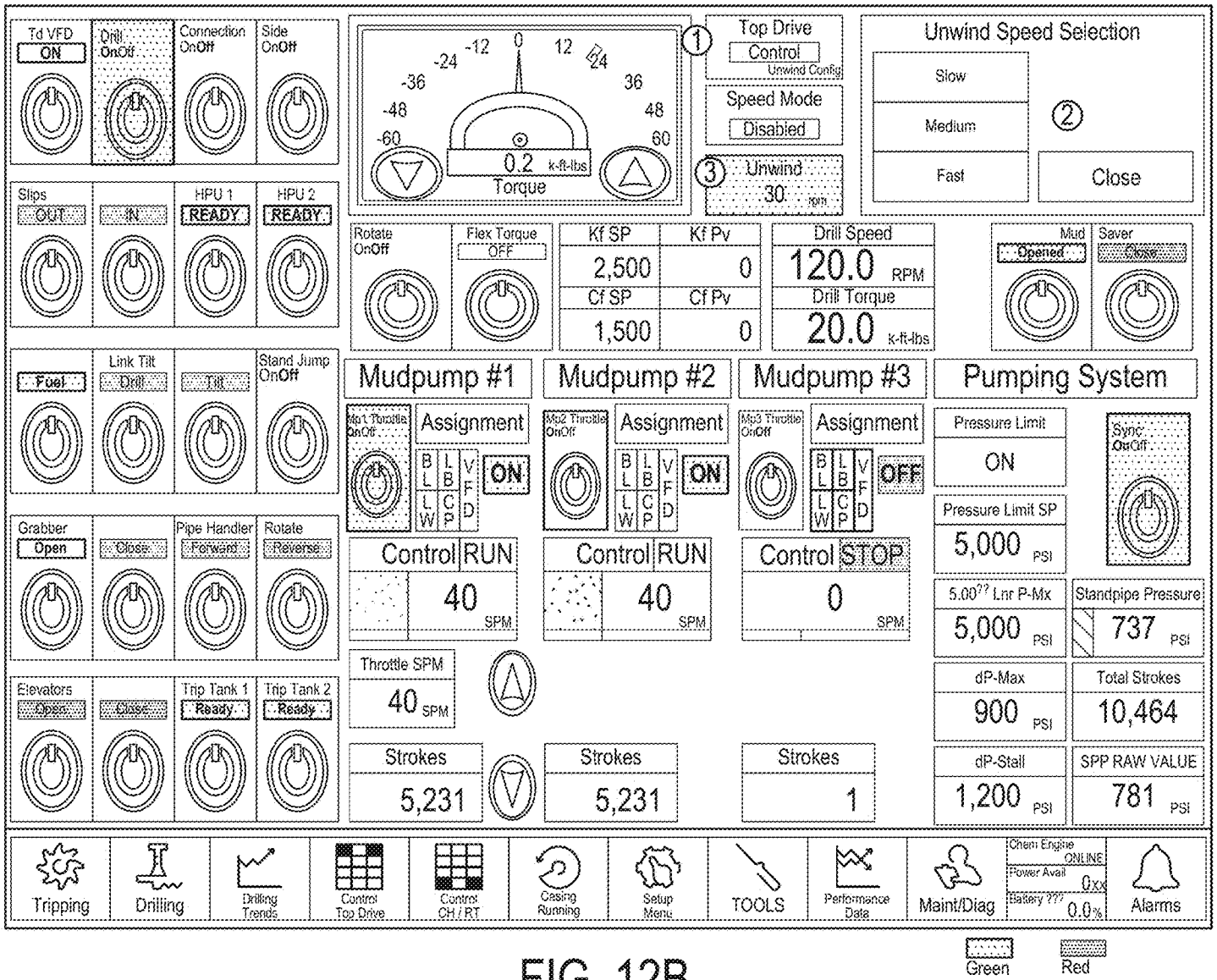

Referring now to FIGS. 12A and 12B, depictions of user interfaces for monitoring and/or controlling torque unwind during drilling are shown. The user interfaces in FIGS. 12A and 12B show a configuration panel for the torque unwind functionality described herein. The disclosed user interfaces may be implemented by the control system 168 herein, in addition to various other user interfaces and user interface elements. For example, the user interfaces may be accessible from a main button in user interface 850 associated with the torque unwind functionality. While FIGS. 12A and 12B depicts particular user interface configurations, these are merely illustrative and alternative configurations with other control or display elements user interfaces may be shown or used by the control system 168. The functionality described herein with respect to the user interfaces and, in particular, the various methods of enabling and disabling automatic functionality, may be implemented in various ways.

In FIGS. 12A and 12B a user interface including at least one or more of a top drive 140 status indicator, a speed meter, and a torque unwind button is shown. In some embodiments, selection of the top drive 140 status indicator may initiate guidance to configure the unwind speed of the top drive 140. For example, a user may select the top drive 140 status indicator causing a separate popup window to appear. The popup window may include elements enabling the configuration of the torque unwind speed. The user interface may include a speed meter indicating the speed of the top drive 140 and/or providing locations to input top drive 140 unwind speed threshold values. For example, a selection of slow/medium/fast unwind speeds may be selectable. In some embodiments, a torque unwind button may be provided. Upon selection of the torque unwind button the torque unwind method may be initiated. For example, when a user selects the torque unwind button, the control system 168 may initiate the unwinding of trapped torque in the drill string 146 as described herein.

In some embodiments, the torque unwind process may be initiated by the user selecting the torque unwind button. Alternatively, and/or additionally, the torque unwind process may be initiated by selecting and holding the torque unwind button for a predetermined period of time. The user interface may include a top drive 140 status indicator. For example, during the torque unwind process, the top drive 140 status indicator may show "unwind," indicating that the torque unwind process has been initiated.

In some embodiments, during drilling operations, the control system 168 may determine that an unwind is needed or appropriate and automatically initiate the torque unwind method. Alternatively, the user interface may present the user with the torque unwind initiation button for activation by the user if the control system 168 is programmed so it may take no further automatic action without user input.

Figure 13:
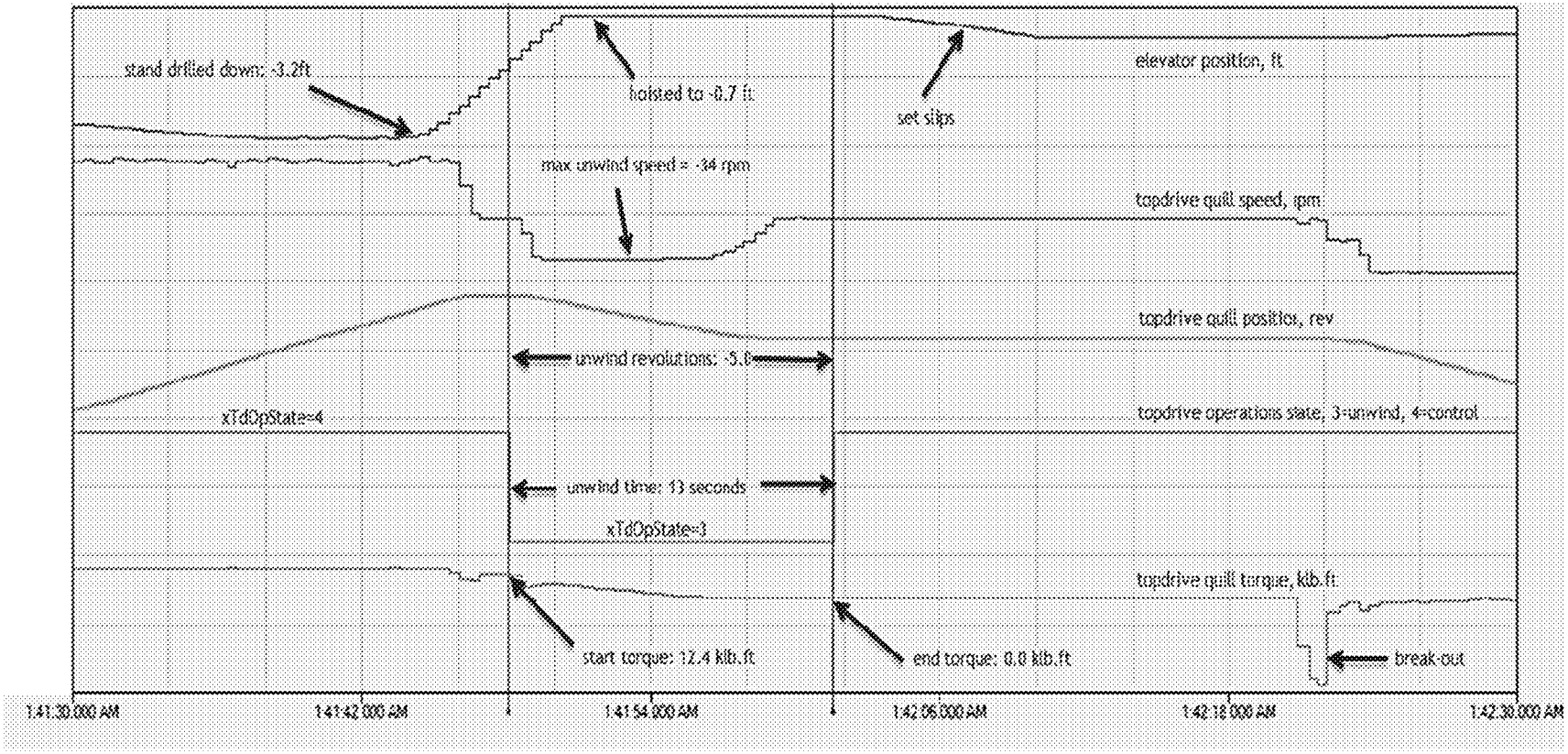
FIG. 13 is a depiction of various parameters before, during, and after torque unwinding, in accordance with embodiments of the present disclosure.

FIG. 13 is a depiction of various parameters before, during, and after torque unwinding. In FIG. 13, the elevator position, top drive 140 quill speed, top drive 140 quill position, top drive 140 operation state, and top drive 140 quill torque are shown. As depicted, at 1:41:48 a.m., the system begins the torque unwind process with a starting torque of 12.4 kilopounds·feet (klb·ft) (klb·ft are sometimes referred to as a kip foot), and at 1:42:01 a.m. finishes the torque unwind process with 0 klbs·ft of torque. The process is thus able to quickly release the torque in the drill string 146 and avoid the overshoot problems of conventional approaches.

In automatic operation, the system and methods described may be used to automatically release the torque in the drill string 146 when appropriate. For example, the control system 168 may be provided with a drill plan for the well being drilled. Based on one or more parameters or information received during drilling (e.g., measurement while drilling data, logging while drilling data, rate of penetration, differential pressure, measured depth, and so forth), the control system 168 may determine that it is appropriate to release the torque in the drill string 146, such as when the control system 168 determines that a slide drilling operation is anticipated soon, or that a new stand of drill pipe is to be added to the drill string 146, or that a mud motor stall has occurred or the like. The control system 168 may then automatically initiate the torque unwind process by sending one or more appropriate control signals to one or more controllers for the VFD and rig control systems 168 (e.g., a top drive 140 controller) to initiate the torque unwind process. The control system 168 may be programmed to monitor the torque unwind process, such as by receiving the relevant parameters for the torque unwind operation and monitoring the same to see if any of them exceed any thresholds thereof and, if that happens, by sending appropriate control signals to control the torque unwind process. The control system 168 may further monitor the torque unwind process and determine when it has been finished, then deactivate the torque unwind process and continue to the next drilling operation (e.g., addition of a stand of drill pipe to the drill string 146, beginning the slide drilling operation, etc.)

The following provides an illustrative example of how torque unwinding of a drill string 146 may be achieved. As previously described, a VFD coupled to the top drive 140 may be used to achieve torque unwinding. To release the torque in the drill string 146 in a controlled manner various parameters may be set via the VFD. For example, a commercially available VFD may include tunable parameters such as zero servo counts, torque reference delay time, and speed limit bias. The rig control system 168 managing the unwind process may include tunable parameters such as unwind torque complete threshold, unwind complete velocity threshold, unwind complete debounce timer setting, minimum unwind command timer setting, and unwind direction change timer setting. In some embodiments, one or more of the settings may be adjustable within the control system 168 to provide flexibility. Alternatively, one or more of the settings may remain fixed. For example, each of the enumerated settings may remain fixed except the speed. A user may be provided with a selection of speeds, such as 15 RPM, 30 RPM, or 45 RPM which correspond to slow, medium, or fast, to empower a user to adjust the speed depending on the drilling rig operation. For example, during casing running, a driller may select a slower value, such as 15 RPM. By adjusting one or more VFD parameters, the torque unwind process may be tuned to achieve a desirable release of torque in the drill string 146. For example, when initialing the VFD, the following VFD setting parameters may be loaded: the zero servo counts may be set to 1000; the torque reference delay time may be set to 300 milliseconds; and the speed limit bias may be set to 1%. Moreover, the top drive 140 unwind rig control system 168 may be initialized in the following manner: the unwind torque complete threshold may be set to 2.0 klbs·ft; the unwind complete velocity threshold may be set to 3.0 RPM; the unwind complete debounce timer setting may be set to 0.5 seconds; the minimum unwind command timer setting may be set to 0.5 seconds; and the unwind direction change timer setting may be set to 1.0 seconds.

Figure 14:
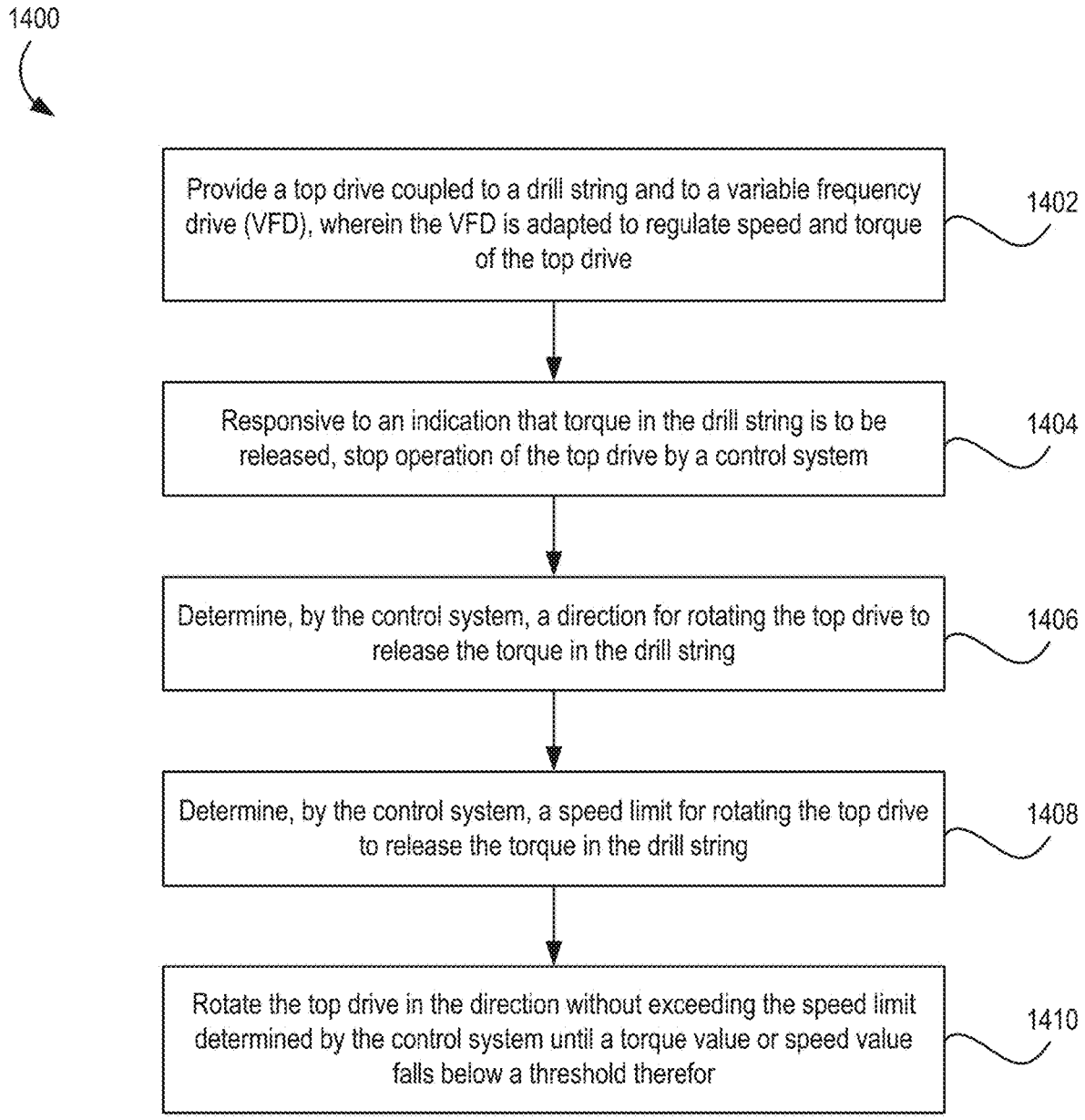
FIG. 14 is a flowchart of a method of releasing torque from a drill string, in accordance with embodiments of the present disclosure.

Referring now to FIG. 14, a method for unwinding the torque in a drill string 146 is shown as a flow chart. While the method 1400 herein is described as being performed via the control system 168, the method 1400 may also be implemented using one or more separate control systems 168. Method 1400 includes operation 1402. Operation 1402 may include providing a top drive coupled to a drill string and to a variable frequency drive (VFD). The VFD may be adapted to regulate speed and torque of the top drive according to any of the embodiments described in detail above.

Method 1400 may further include operation 1404. Operation 1404 may include, responsive to an indication that torque in the drill string is to be released, stopping operation of the top drive by a control system. The control system may be coupled to a user interface that displays a status mode responsive to whether torque in the drill string is to be released or is in a process of being released. Once the top drive is stopped, the VFD may be kept in, or placed in, a second mode. The indication that torque in the drill string is to be released may be based on a user input. In further embodiments, the indication that torque in the drill string is to be released includes a determination, by the control system, associated with an anticipated drilling event including a slide drilling operation, a connection of a drill pipe or stand to the drill string, responsive to a mud motor or rotary drilling stall, torquing a drill pipe or stand against a rotary table or back-up wrench, or the like.

According to various embodiments, the VFD has a torque control mode and, responsive to the indication that torque in the drill string is to be released, the VFD is placed into torque control mode. For example, a torque setpoint provided to the VFD may be zero and a speed limit setpoint is provided to the VFD. The torque setpoint may be zero without regard to direction of rotation.

Operation 1406 may include determining, by the control system, a direction for rotating the top drive to release the torque in the drill string. In some embodiments, operation 1406 includes determining, by the control system, a sign of a torque feedback value. For example, the direction is reverse if the sign is positive, and the direction is forward if the sign is negative. Determining the direction for rotating the top drive may be responsive to the sign of the torque feedback value. In some embodiments, operation 1406 may include, determining, when the top drive is rotating in reverse, the torque is released if the torque feedback value of the top drive falls below a torque threshold value and if an absolute value of a velocity feedback value of the top drive is less than a speed threshold value. In further embodiments, operation 1406 may include, determining, when the top drive is rotating in forward, the torque is released if the torque feedback value rises above a negative of the torque threshold value and if the absolute value of the velocity feedback value is less than the speed threshold value.

Operation 1408 may include determining, by the control system, a speed limit for rotating the top drive to release the torque in the drill string. In some embodiments, determining a speed limit for rotating the top drive to release the torque may include receiving a user input associated with a speed limit for rotating the top drive. A user or the control system may select the speed limit.

Operation 1410 may include rotating the top drive in the direction without exceeding the speed limit determined by the control system until a torque value or speed value falls below a threshold therefor.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents and shall not be restricted or limited by the foregoing detailed description.

What is claimed is:

1. A method of releasing torque from a drill string, the method comprising:

providing a top drive coupled to a drill string and to a variable frequency drive (VFD), wherein the VFD is adapted to operate in at least two modes of operation, wherein a first mode regulates speed of the top drive based on a speed limit, wherein a second mode regulates torque of the top drive;

responsive to an indication that torque in the drill string is to be released, stopping operation of the top drive by a control system;

determining, by the control system, a direction for rotating the top drive to release the torque in the drill string;

determining, by the control system, the speed limit for rotating the top drive to release the torque in the drill string;

transitioning, by the control system, the VFD from the first mode to the second mode;

determining, by the control system, a torque value for the top drive; and rotating the top drive in the direction without exceeding the speed limit determined by the control system until a torque value or speed value falls below a threshold therefor.

2. The method according to claim 1, further comprising determining, by the control system, a sign of a torque feedback value.

3. The method according to claim 2, wherein determining the direction for rotating the top drive is responsive to the sign of the torque feedback value.

4. The method according to claim 3, wherein the indication that torque in the drill string is to be released comprises a user input.

5. The method according to claim 3, wherein the indication that torque in the drill string is to be released comprises a determination, by the control system, associated with an anticipated drilling event.

6. The method according to claim 5, wherein the anticipated drilling event comprises any one or more of: a slide drilling operation, a connection of a drill pipe or stand to the drill string, responsive to a mud motor or rotary drilling stall, and torquing a drill pipe or stand against a rotary table or back-up wrench.

7. The method according to claim 1, wherein determining a speed limit for rotating the top drive to release the torque comprises receiving a user input associated with a speed limit for rotating the top drive.

8. The method according to claim 1, wherein a torque setpoint provided to the VFD is zero and a speed limit setpoint is provided to the VFD.

9. The method according to claim 8, wherein the torque setpoint is zero without regard to direction of rotation.

10. The method according to claim 1, wherein a user or the control system selects the speed limit.

11. The method according to claim 1, wherein the control system is coupled to a user interface that displays a status mode responsive to whether torque in the drill string is to be released or is in a process of being released.

12. A control system for controlling a release of torque from a drill string, the control system comprising:

a processor connected to one or more control systems of a drilling rig enabled to drill a borehole; and a memory connected to the processor, wherein the memory comprises instructions for performing operations comprising:

receiving an indication that torque in a drill string coupled to a top drive is to be released, the top drive coupled to a variable frequency drive (VFD) adapted to operate in at least two modes of operation, wherein a first mode regulates speed of the top drive based on a speed limit and a second mode regulates torque of the top drive;

responsive to the indication, stopping operation of the top drive;

determining, by the one or more control systems, a direction for rotating the top drive to release the torque in the drill string;

determining, by the one or more control systems, the speed limit for rotating the top drive to release the torque in the drill string;

transition the VFD from the first mode to the second mode;

determine a torque value for the top drive; and rotating the top drive in the direction and at the speed limit determined by the one or more control systems until a torque value or speed value falls below a threshold value.

13. The control system of claim 12, wherein the indication that torque in the drill string is to be released comprises a determination, by the control system, associated with an anticipated drilling event.

14. The control system of claim 13, wherein the anticipated drilling event comprises any one or more of: a slide drilling operation, a connection of a drill pipe or stand to the drill string, responsive to a mud motor or rotary drilling stall, and torquing a drill pipe or stand against a rotary table or back-up wrench.

15. The control system of claim 12, wherein determining a speed limit for rotating the top drive comprises receiving a user input or a control system value associated with a speed limit for rotating the top drive.

16. The control system of claim 12, wherein the VFD has a torque control mode and, responsive to the indication that torque in the drill string is to be released, the VFD is placed into torque control mode, wherein a torque setpoint provided to the VFD is zero and a speed limit setpoint is provided to the VFD.

17. The control system of claim 16, wherein the torque setpoint is zero without regard to direction of rotation.

18. A method of releasing torque from a drill string, the method comprising:

receiving an indication to initiate release of torque in a drill string coupled to a top drive, the top drive coupled to a variable frequency drive (VFD) adapted to operate in at least two modes of operation, wherein a first mode regulates speed of the top drive based on a velocity limit and a second mode regulates torque of the top drive;

in response to receiving the indication, transitioning the VFD to the second mode;

setting, via the VFD, a zero torque setpoint;

determining a direction for rotating the top drive based at least in part on sign of a torque feedback value, wherein the direction is reverse if the sign is positive, and the direction is forward if the sign is negative;

setting, via the VFD, the velocity limit of the top drive to a negative value if the direction is reverse or to a positive value if the direction is forward;

rotating the top drive in the determined direction, the VFD regulating the speed based on the velocity limit;

determining, when the top drive is rotating in reverse, the torque is released if the torque feedback value of the top drive falls below a torque threshold value and if an absolute value of a velocity feedback value of the top drive is less than a speed threshold value; and determining, when the top drive is rotating in forward, the torque is released if the torque feedback value rises above a negative of the torque threshold value and if the absolute value of the velocity feedback value is less than the speed threshold value.

* * * * *